US010406835B2

(12) United States Patent
Tamura et al.

(10) Patent No.: US 10,406,835 B2
(45) Date of Patent: Sep. 10, 2019

(54) TRANSPORT ROLLER

(71) Applicant: SEIKO EPSON CORPORATION, Tokyo (JP)

(72) Inventors: Yosaku Tamura, Nagano (JP); Akinobu Nakahata, Nagano (JP); Teppei Sugeta, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/024,987

(22) Filed: Jul. 2, 2018

(65) Prior Publication Data

US 2018/0319182 A1 Nov. 8, 2018

Related U.S. Application Data

(63) Continuation of application No. 15/447,647, filed on Mar. 2, 2017, now Pat. No. 10,040,301.

(30) Foreign Application Priority Data

Mar. 9, 2016 (JP) ..... 2016-045577

(51) Int. Cl.

| | |
|---|---|
| ***B41J 2/01*** | (2006.01) |
| ***B41J 13/26*** | (2006.01) |
| ***B41J 13/076*** | (2006.01) |
| ***B65H 5/06*** | (2006.01) |

(52) U.S. Cl.

CPC ..... *B41J 13/26* (2013.01); *B41J 2/01* (2013.01); *B41J 13/076* (2013.01); *B65H 5/062* (2013.01); *B65H 2404/1115* (2013.01); *B65H 2404/1321* (2013.01)

(58) Field of Classification Search

None

See application file for complete search history.

(56) References Cited

U.S. PATENT DOCUMENTS

| | | | | |
|---|---|---|---|---|
| 5,163,674 | A | 11/1992 | Parks | |
| 5,850,233 | A | 12/1998 | Otsuka et al. | |
| 8,955,966 | B2 * | 2/2015 | Norikane | B41J 13/26 226/190 |
| 2003/0193135 | A1 | 10/2003 | Suzuki | |

FOREIGN PATENT DOCUMENTS

| | | | |
|---|---|---|---|
| JP | 03-293175 | A | 12/1991 |
| JP | 2006-347119 | A | 12/2006 |
| JP | 2012-240773 | A | 12/2012 |

* cited by examiner

*Primary Examiner* — Matthew Luu
*Assistant Examiner* — Tracey M McMillion

(57) ABSTRACT

A transport roller for a printing apparatus transports a medium. The transport roller includes a shaft that extends in a direction intersecting a transport direction of the medium, and a wheel group in which a plurality of toothed wheels arrayed in the direction in which the shaft extends are held by holders. The toothed wheel includes non-formation portions having no teeth. The non-formation portions of the plurality of toothed wheels of the wheel group are arranged with an interval therebetween in a circumferential direction of the toothed wheels. The non-formation portions are cut portions that are formed when the toothed wheel is cut off from a base. The teeth other than the teeth adjacent to the cut portions are arranged away from each other at regular intervals in a circumferential direction of the wheel group.

10 Claims, 13 Drawing Sheets

TRANSPORT ROLLER

CROSS-REFERENCE TO RELATED APPLICATIONS

This application is a continuation application of U.S. patent application Ser. No. 15/447,647 filed on Mar. 2, 2017. This application claims priority to Japanese Patent Application No. 2016-045577 filed on Mar. 9, 2016. The entire disclosures of U.S. patent application Ser. No. 15/447,647 and Japanese Patent Application No. 2016-045577 are expressly incorporated herein by reference.

BACKGROUND

1. Technical Field

The present invention relates to a roller that transports a medium such as a paper sheet.

2. Related Art

As this type of printing apparatus, there is known an ink jet printer that performs printing on a medium such as a paper sheet by ejecting liquid such as ink onto the medium that is being transported by transport rollers. As an example of this type of printer, there is provided a printer having spurs that nip and transport a medium subjected to printing (see, for example, JP-A-2006-347119). The spur of JP-A-2006-347119 is formed of a circular metal sheet (wheel) that has a plurality of tooth tips, and a molded member (holder) that is molded integrally with the metal sheet and supports the metal sheet in a rotatable manner. Two spurs are provided so as to be adjacent to each other in a width direction of the medium that intersects a transport direction of the medium. The spurs as described above transport the medium in such a manner that the tooth tips of the metal sheets are brought into contact with the medium. With this operation, the contact area between the medium and the spurs is reduced, thereby suppressing transfer of ink from the medium.

In the spur of JP-A-2006-347119, the metal sheet (wheel) is formed by press working, and hence the metal sheet is formed by cutting off tie-bar portions that couple a base material and the metal sheet to each other. Therefore, tie-bar cut portions (cut portions) are formed on the outer periphery of the metal sheet in addition to the tooth tips. The shape of the tie-bar cut portion is different from the shape of the tooth tip and is formed on a radially inner side of the metal sheet with respect to the tooth tip. Therefore, when the number of teeth of the metal sheet increases, an imaginary circle formed by connecting the tooth tips of the metal sheet into a circle differs from a perfect circle because the tooth cannot be formed at a portion where the tie-bar cut portion is formed. When the spurs are viewed in an axial direction (width direction of the medium) orthogonal to the side surfaces of the metal sheets thereof, if the tie-bar cut portions of the metal sheets adjacent to each other in the axial direction overlap each other or are distributed unevenly in a circumferential direction of the spurs, the shapes of the spurs differ from a perfect circle. As a result, the transport accuracy of the medium to be transported by the spurs may be decreased.

This problem may arise not only in the spurs described in JP-A-2006-347119 but also in rollers that transport a medium by metal sheets (wheels) having tie-bar cut portions.

SUMMARY

An advantage of some aspects of the invention is that a printing apparatus including a roller capable of suppressing a decrease in the transport accuracy of a medium is provided.

Some aspects of the invention and operations and advantages thereof are described below.

A transport roller for a printing apparatus according to an aspect of the invention transports a medium. The transport roller includes a shaft that extends in a direction intersecting a transport direction of the medium, and a wheel group in which a plurality of toothed wheels arrayed in the direction in which the shaft extends are held by holders. The toothed wheel includes non-formation portions having no teeth. The non-formation portions of the plurality of toothed wheels of the wheel group are arranged with an interval therebetween in a circumferential direction of the toothed wheels. The non-formation portions are cut portions that are formed when the toothed wheel is cut off from a base. The teeth other than the teeth adjacent to the cut portions are arranged away from each other at regular intervals in a circumferential direction of the wheel group.

A transport roller for a printing apparatus according to an aspect of the invention transports a medium. The transport roller includes a shaft that extends in a direction intersecting a transport direction of the medium, and a wheel group in which a plurality of toothed wheels arrayed in the direction in which the shaft extends are held by holders. The toothed wheel includes non-formation portions having no teeth, each of the non-formation portions protruding radially outwardly from a root of teeth of the toothed wheel. The non-formation portions of the plurality of toothed wheels of the wheel group are arranged with an interval therebetween in a circumferential direction of the toothed wheels.

A transport roller for a printing apparatus according to an aspect of the invention transports a medium. The transport roller includes a shaft that extends in a direction intersecting a transport direction of the medium, and a wheel group in which a plurality of toothed wheels arrayed in the direction in which the shaft extends are held by holders, each of the plurality of toothed wheels being stacked alternately with each of the holders so that two adjacent toothed wheels are connected by one of the holders therebetween. The toothed wheel includes non-formation portions having no teeth. The non-formation portions of the plurality of toothed wheels of the wheel group are arranged with an interval therebetween in a circumferential direction of the toothed wheels.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

A printing apparatus according to a first embodiment of the invention is described below with reference to the drawings. The printing apparatus of this embodiment is an ink jet printer that forms characters and images on a paper sheet that is an example of a medium by ejecting ink that is an example of liquid onto the paper sheet.

Figure 1:
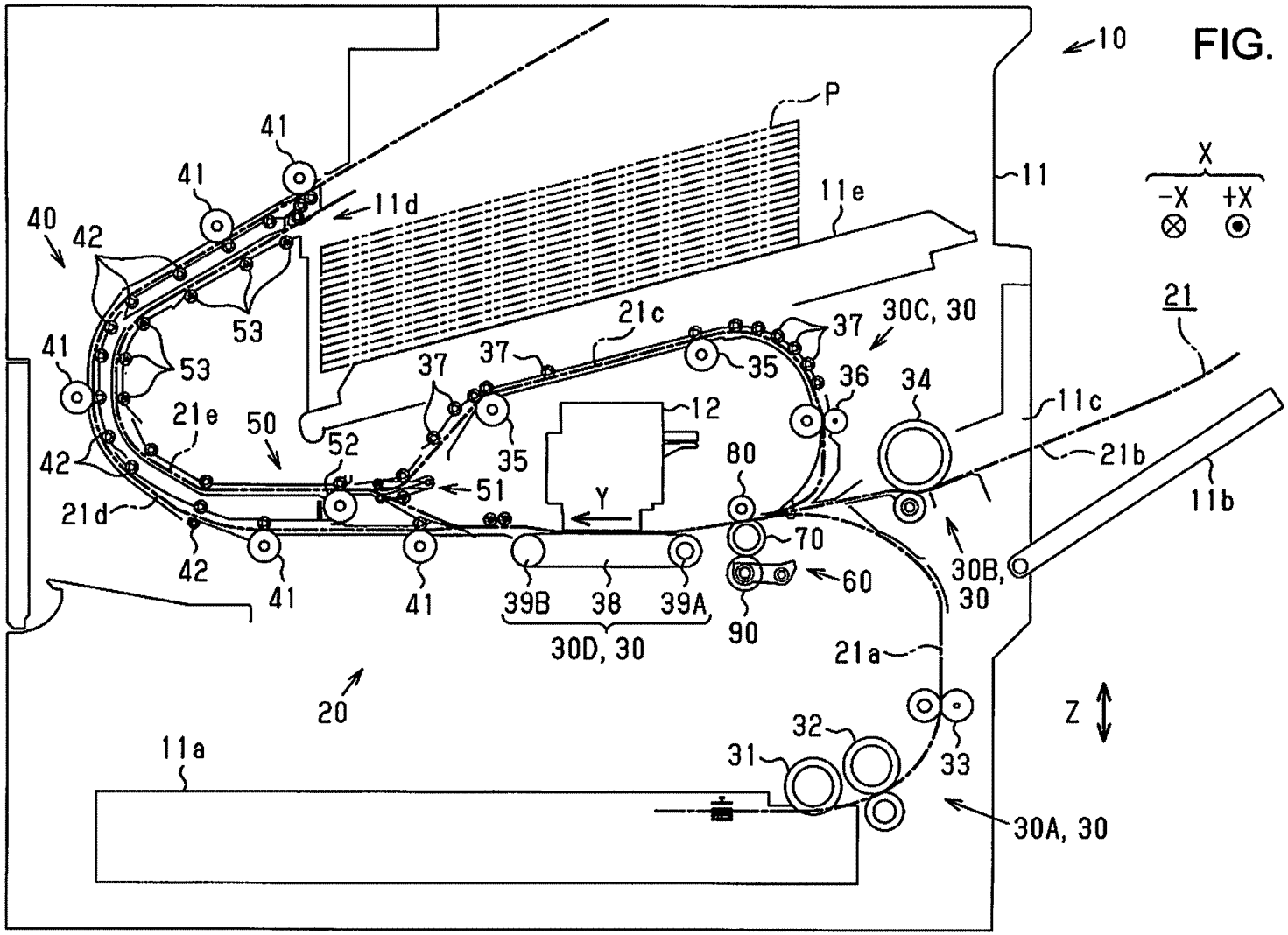
FIG. 1 is a side view schematically illustrating the overall structure of a printing apparatus according to a first embodiment of the invention.

As illustrated in FIG. 1, a printing apparatus 10 includes, in a casing 11 thereof, a transport apparatus 20 that transports a paper sheet P along a transport path 21 indicated by the thick chain line in FIG. 1, and a printing section 12 that performs printing on the paper sheet P that is being transported by the transport apparatus 20. When a direction orthogonal to the drawing sheet of FIG. 1 is defined as a width direction X of the paper sheet P, the transport path 21 is formed so as to transport the paper sheet P in a direction intersecting (preferably orthogonal to) the width direction X of the paper sheet P.

In the following description, the direction in which the paper sheet P is transported is defined as a "transport direction Y", and a direction of a vertical component is defined as a "vertical direction Z". The transport direction Y is a direction intersecting (preferably orthogonal to) the width direction X, and the vertical direction Z is a direction intersecting (preferably orthogonal to) the width direction X and the transport direction Y. In the width direction X, a leftward direction (in the direction of the front side of the drawing sheet) as viewed from an upstream side in the transport direction Y is defined as a "+X direction", and a rightward direction (in the direction of the back side of the drawing sheet) as viewed from the upstream side in the transport direction Y is defined as a "−X direction".

The printing section 12 is a so-called line head including liquid ejecting heads capable of simultaneously ejecting ink in the width direction X. The printing section 12 performs printing by ejecting ink toward the paper sheet P that is transported by the transport apparatus 20 so as to face the printing section 12.

The transport apparatus 20 includes a sheet feeding section 30 that transports the paper sheet P to the printing section 12, the sheet discharging section 40 that transports the paper sheet P subjected to printing by the printing section 12 to the outside of the casing 11, and a branching section 50 that switches back the paper sheet P subjected to printing on one side by the printing section 12 to transport the paper sheet P to the printing section 12 again at the time of duplex printing of the paper sheet P.

The sheet feeding section 30 includes a first sheet feeding portion 30A, a second sheet feeding portion 30B, and a third sheet feeding portion 30C that constitute, in the transport path 21, three sheet feeding paths along which the paper sheet P is transported to the printing section 12, and a support transport portion 30D that transports the paper sheet P transported from each of the sheet feeding portions 30A to 30C toward a downstream side in the transport direction Y while supporting the paper sheet P. The three sheet feeding paths constituted by the first sheet feeding portion 30A, the second sheet feeding portion 30B, and the third sheet feeding portion 30C join each other on an upstream side in the transport direction Y with respect to the support transport portion 30D.

The first sheet feeding portion 30A transports the paper sheet P along a first sheet feeding path 21*a* of the transport path 21 (sheet feeding path) that connects the printing section 12 to a paper sheet cassette 11*a* provided at the lower end of the casing 11. The first sheet feeding portion 30A is provided with a pickup roller 31, a separation roller pair 32, and a first sheet feeding roller pair 33 in this order from the upstream side to the downstream side in the transport direction Y along the first sheet feeding path 21*a*. The paper sheets P which are located uppermost of the paper sheets P stacked on the paper sheet cassette 11*a* are sent out by the pickup roller 31 and separated one by one by the separation roller pair 32. Then, one paper sheet P separated by the separation roller pair 32 is transported to the printing section 12 by the first sheet feeding roller pair 33.

The second sheet feeding portion 30B transports the paper sheet P along a second sheet feeding path 21*b* of the transport path 21 (sheet feeding path) that connects the printing section 12 to an insertion portion 11*c* to be exposed by opening a cover 11*b* provided on one side surface of the casing 11. The paper sheet P inserted from the insertion portion 11*c* is transported to the printing section 12 while being nipped by a second sheet feeding roller pair 34.

The third sheet feeding portion 30C transports the paper sheet P subjected to printing by the printing section 12 to the printing section 12 (support transport portion 30D) again along a third sheet feeding path 21*c* of the transport path 21 (sheet feeding path) that is provided so as to pass around the printing section 12. The third sheet feeding path 21*c* is provided with at least one transport roller pair (two transport roller pairs 35 in this embodiment), and a third sheet feeding roller pair 36. The third sheet feeding roller pair 36 is provided on a downstream side of the third sheet feeding path 21*c* with respect to the two transport roller pairs 35. A plurality of transport driven rollers 37 are provided on an upstream side of the third sheet feeding path 21*c* with respect to the third sheet feeding roller pair 36. The paper sheet P subjected to printing by the printing section 12 is transported while being guided along the third sheet feeding path 21*c* by the transport driven rollers 37 and nipped by the two transport roller pairs 35. The paper sheet P transported by the transport roller pairs 35 is transported while being guided by the transport driven rollers 37 which are provided on the downstream side of the third sheet feeding path 21*c* with respect to the transport roller pairs 35, and is then transported to the printing section 12 again while being nipped by the third sheet feeding roller pair 36.

The support transport portion 30D is provided in the transport path 21 (sheet feeding path) so as to face the printing section 12 in the vertical direction. The support transport portion 30D transports the paper sheet P by causing a transport belt 38 facing the printing section 12 to circulate while supporting, by electrostatic attraction, the paper sheet P on a belt surface that is the outer peripheral surface of the transport belt 38. Specifically, the transport belt 38 is an endless belt looped around two rollers that are a driving roller 39A to be rotated through driving of a driving source, and a driven roller 39B to be rotated along with the circulation of the transport belt 38. The transport belt 38 circulates along with the rotation of the driving roller 39A and is charged with static electricity by a charging roller (not shown) that is brought into contact with the belt surface while the transport belt 38 is circulating. With the static electricity generated as a result of charging the transport belt 38, the transport belt 38 attracts the paper sheet P on the flat belt surface which is formed between the driving roller 39A and the driven roller 39B and transports the attracted paper sheet P toward the downstream side in the transport direction Y while causing the paper sheet P to face the printing section 12.

The sheet discharging section 40 transports the paper sheet P along a sheet discharging path 21*d* of the transport path 21 that connects the printing section 12 to a discharging port 11*d* through which the paper sheet P subjected to printing is discharged. The paper sheet P discharged from the discharging port lid is mounted on a mounting table lie provided in the casing 11. The sheet discharging section 40 includes at least one sheet discharging roller pair (five sheet discharging roller pairs 41 in this embodiment). The sheet discharging roller pair 41 transports the paper sheet P along the sheet discharging path 21*d* while nipping the paper sheet P. Further, one or a plurality of driven rollers 42 are provided between the sheet discharging roller pairs 41 adjacent to each other in the sheet discharging path 21*d*.

The branching section 50 transports the paper sheet P along a branching path 21*e* that branches from an upstream portion of the sheet discharging path 21*d* in the transport path 21 and then transports the paper sheet P toward the printing section 12 again along the branching path 21*e*. The branching section 50 includes a branching mechanism 51 that is provided on a downstream side in the transport direction Y with respect to the printing section 12 and is configured such that the paper sheet P transported to the sheet discharging path 21*d* can be guided to the branching path 21*e* and the paper sheet P transported to the branching path 21*e* can be guided to the third sheet feeding path 21*c*. The branching mechanism 51 is constituted by, for example, a flap. On a downstream side of the branching path 21*e* with respect to the branching mechanism 51, there are provided a branching transport roller pair 52 that transports the paper sheet P along the branching path 21*e* and is rotatable in forward/reverse directions, and a plurality of driven transport rollers 53 that guide the paper sheet P transported to the branching path 21*e*.

At the time of duplex printing, the paper sheet P subjected to printing on one side by the printing section 12 is guided to the branching path 21*e* by the branching mechanism 51 and is transported along the branching path 21*e* by driving the branching transport roller pair 52 to rotate in the forward direction. Then, the paper sheet P transported along the branching path 21*e* is transported in reverse along the branching path 21*e* by driving the branching transport roller pair 52 to rotate in the reverse direction, and the paper sheet P is guided to the third sheet feeding path 21*c* by the branching mechanism 51. That is, the branching transport roller pair 52 switches back the paper sheet P in the branching path 21*e*. Then, the paper sheet P guided to the third sheet feeding path 21*c* is transported along the third sheet feeding path 21*c*, and hence the positioning of the paper sheet P in the vertical direction Z is reversed. Accordingly, the paper sheet P is transported to the printing section 12 so that the surface of the paper sheet P which has not been subjected to printing faces the printing section 12.

Further, the transport apparatus 20 includes a correction roller pair 60 as an example of registration rollers that are provided between the support transport portion 30D and the joining position of the sheet feeding portions 30A to 30C in the transport path 21 and that correct skew feed of the paper sheet P. In a state in which the rotation of the correction roller pair 60 is stopped, the leading edge of the paper sheet P transported along each of the sheet feeding portions 30A to 30C abuts the correction roller pair 60, thereby correcting the skew feed of the paper sheet P. Then, the correction roller pair 60 is driven to transport the paper sheet P, the skew feed of which has been corrected, onto the support transport portion 30D.

The correction roller pair 60 includes a correction driving roller 70 as an example of the roller, and a correction driven roller 80 that is rotated in accordance with the rotation of the correction driving roller 70.

The correction driving roller 70 and the correction driven roller 80 are juxtaposed in the vertical direction Z. The correction driving roller 70 is rotatable through driving of a driving source such as an electric motor and is arranged at a position opposite the printing section 12 with respect to the transport path 21, that is, arranged below the printing section 12. The correction driven roller 80 is arranged at a position on the printing section 12 side with respect to the transport path 21, that is, above the correction driving roller 70. Further, a cleaning section 90 capable of cleaning the correction driving roller 70 is provided in the casing 11. The cleaning section 90 is arranged so as to be adjacent to a lower side of the correction driving roller 70.

Figure 2:
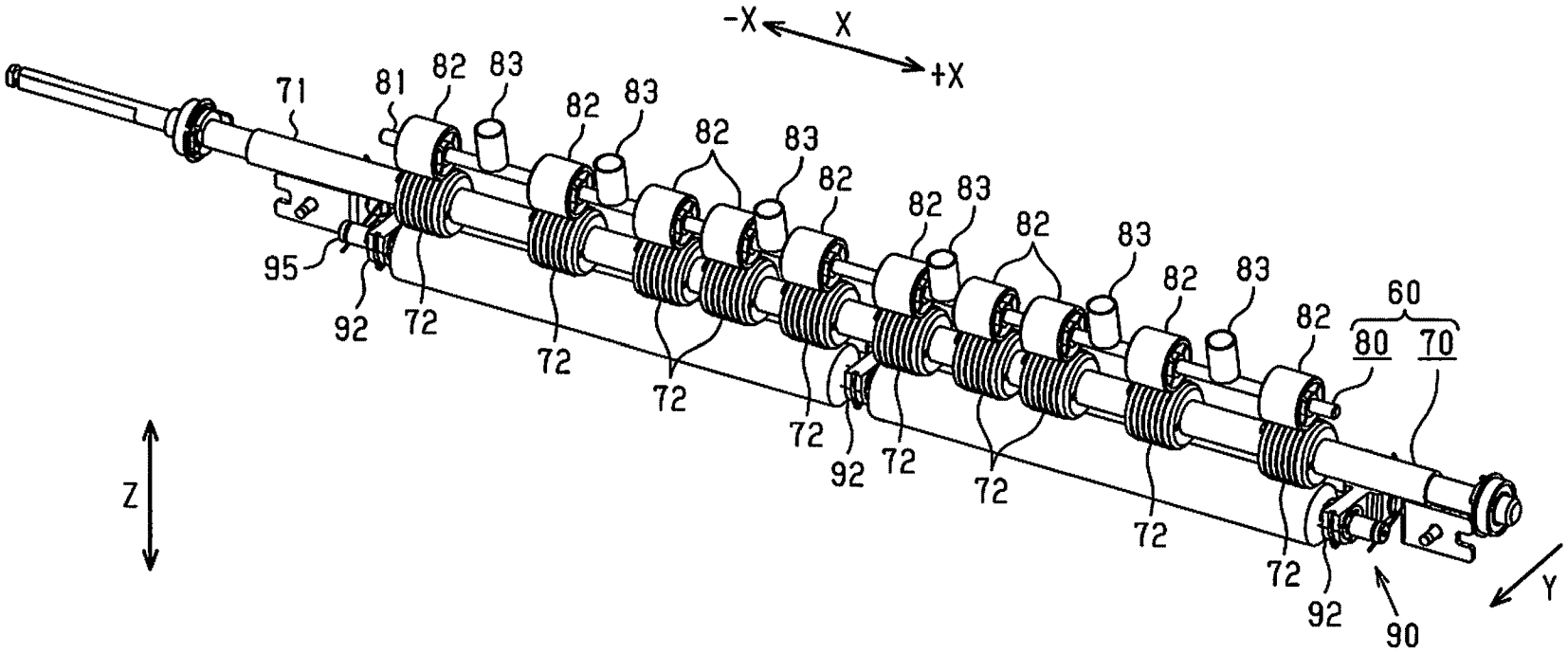
FIG. 2 is a perspective view of a correction roller pair and a cleaning section.

As illustrated in FIG. 2, the correction driving roller 70 includes a driving shaft 71 as an example of a rotary shaft that extends in the width direction X, and a plurality of toothed rollers 72 (ten toothed rollers 72 in this embodiment) as an example of a wheel group that is fixed to the driving shaft 71. The toothed rollers 72 are fixed to the driving shaft 71 while being arrayed with intervals in the width direction X in which the driving shaft 71 extends and are provided so as to be integrally rotatable with the driving shaft 71.

The correction driven roller 80 includes a driven shaft 81 that extends in the width direction X, and a plurality of driven rollers 82 (ten driven rollers 82 in this embodiment) that are fixed to the driven shaft 81. The driven rollers 82 are arranged at positions where the driven rollers 82 face the toothed rollers 72 in the vertical direction Z and are supported so as to be rotatable relative to the driven shaft 81. The driven rollers 82 are provided so that the peripheral surfaces thereof become uniformly circular peripheral surfaces with no irregularities and are configured to be brought into surface contact with the transported paper sheet P (see FIG. 1) while being rotated in accordance with the movement of the paper sheet P. Further, the correction driven roller 80 includes urging members 83 such as coil springs that extend vertically upward and are provided on the driven shaft 81 at a plurality of positions (six positions in this embodiment) different from the positions where the driven rollers 82 are arranged. The urging members 83 urge the correction driven roller 80 toward the correction driving roller 70 by pressing the driven shaft 81 downward.

Figure 3:
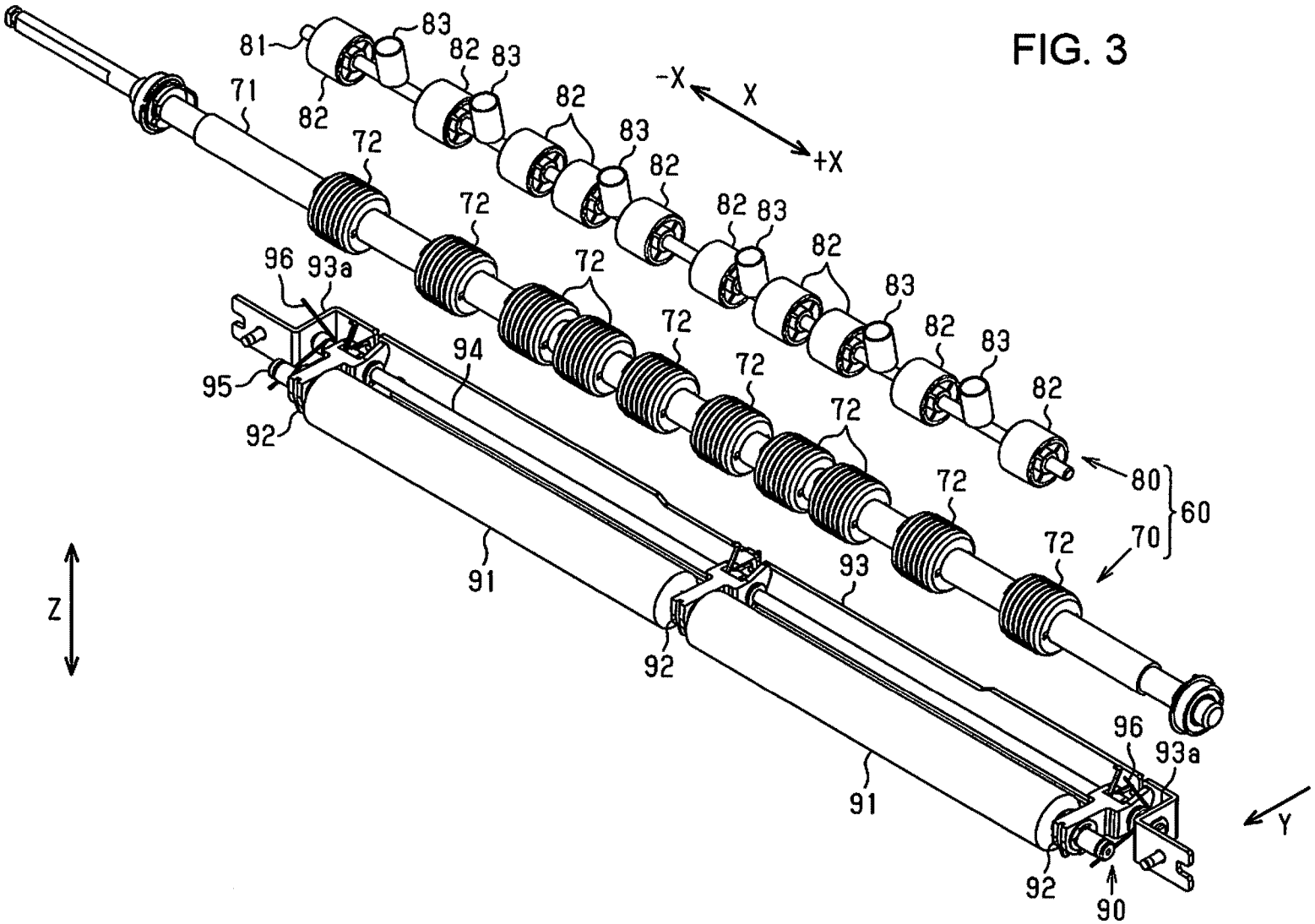
FIG. 3 is a perspective view of a correction driving roller and a correction driven roller that are examples of rollers constituting the correction roller pair, and the cleaning section.

As illustrated in FIG. 3, the cleaning section 90 includes cleaning members 91 to be brought into contact with the correction driving roller 70, arm portions 92 that support the cleaning members 91, and a support plate 93 that supports the arm portions 92. The support plate 93 is a member elongated in the width direction X, and bent portions 93*a* that are bent toward the downstream side in the transport direction Y are provided at both ends of the support plate 93 in the width direction X. Further, the support plate 93 is provided with a single first support shaft 94 extending in the width direction X so as to penetrate the bent portions 93*a*. Three arm portions 92 are fixed to the first support shaft 94 with intervals in the width direction X, and are supported so as to be rotatable relative to the first support shaft 94. At the tip ends of the arm portions 92 which are located opposite the base ends through which the first support shaft 94 is inserted, a second support shaft 95 extending in the width direction X is provided so as to penetrate the arm portions 92. Two cylindrical cleaning members 91 are fixed to the second support shaft 95. Each cleaning member 91 is arranged between the arm portions 92 adjacent to each other in the width direction X. Five toothed rollers 72 face each single cleaning member 91. The cleaning members 91 are provided so as to be rotatable in accordance with the driving rotation of the correction driving roller 70.

Further, torsion springs 96 are provided to the arm portions 92 located at both ends of the support plate 93 in the width direction X. The torsion springs 96 urge the tip ends of the arm portions 92 toward the correction driving roller 70. That is, the cleaning members 91 provided at the tip ends of the arm portions 92 are urged toward the toothed rollers 72. Thus, the cleaning members 91 are held in contact with the lower ends of the toothed rollers 72 of the correction driving roller 70. Each cleaning member 91 is formed of a material (foam) that is excellent in flexibility and water retention property, such as a foamed plastic, thereby being capable of wiping out ink adhering to the toothed rollers 72.

Figure 4:
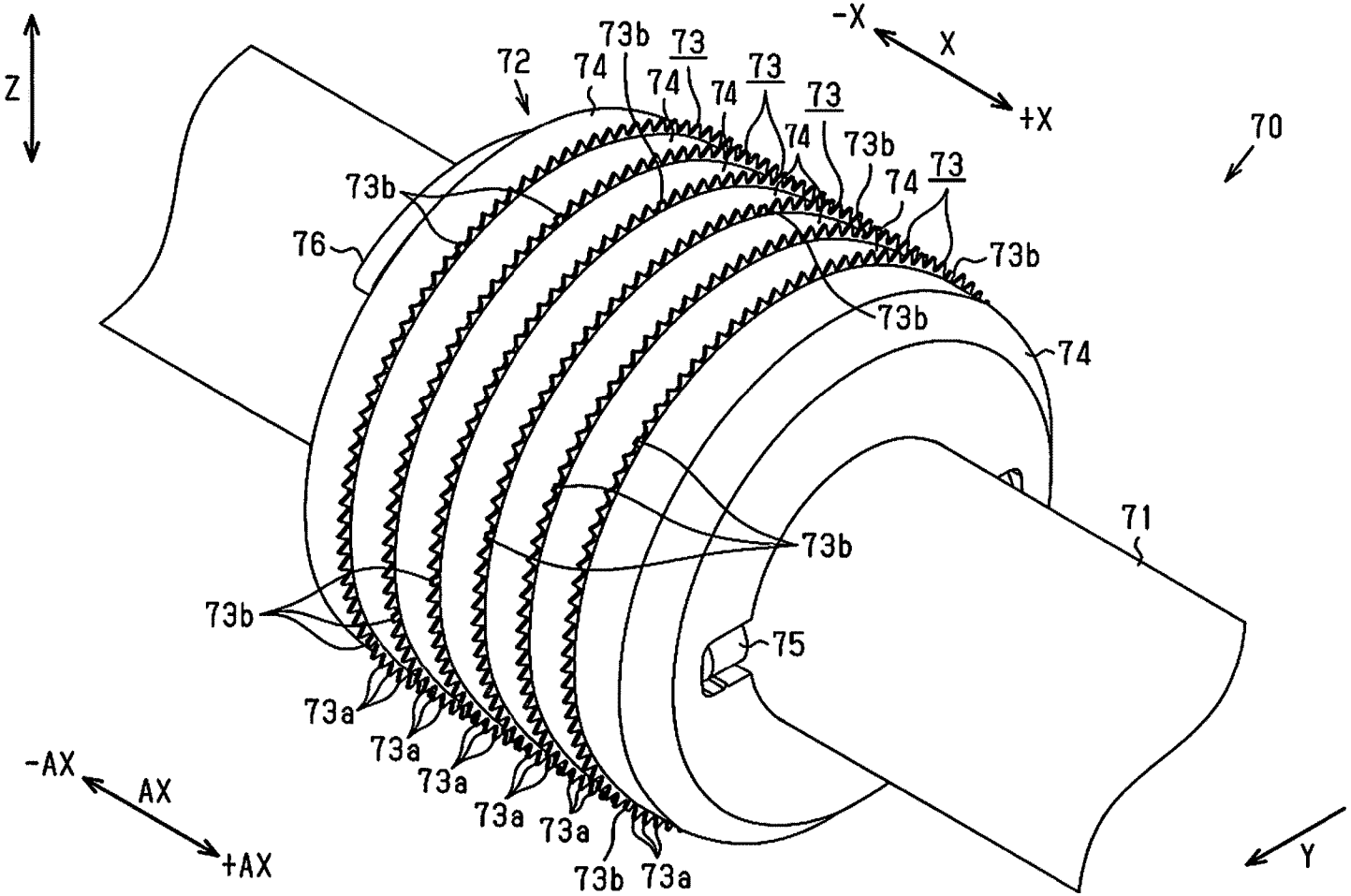
FIG. 4 is a perspective view of a toothed roller constituting the correction driving roller.
Figure 5:
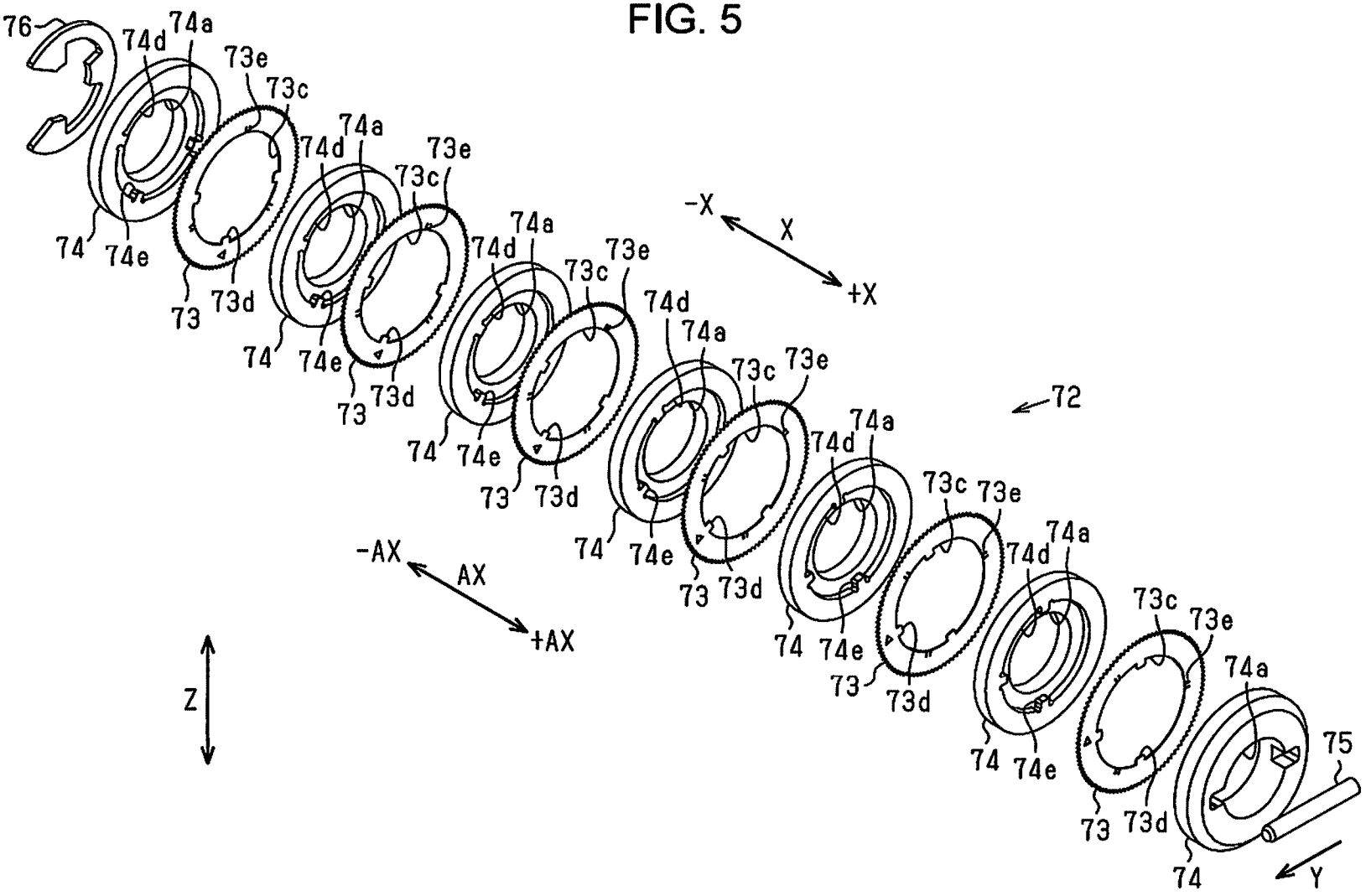
FIG. 5 is an exploded perspective view of the toothed roller including wheels and holders.

As illustrated in FIG. 4 and FIG. 5, the toothed roller 72 is constructed such that a plurality of wheels 73 (six wheels 73 in this embodiment) configured to be brought into contact with the paper sheet P (see FIG. 1) and a plurality of holders 74 (seven holders 74 in this embodiment) that hold the wheels 73 are assembled so as to be stacked alternately in the width direction X. Thus, the toothed roller 72 is constructed such that the plurality of wheels 73 are fixed to the plurality of holders 74 while being arrayed with intervals in an axial direction AX (identical to the width direction X in this embodiment) orthogonal to the side surfaces of the wheels 73. In this embodiment, the wheels 73 are held by being mounted on the respective surfaces of the six holders 74 on a −AX side of the axial direction AX (identical to the −X side of the width direction X), which are different from the holder 74 located at the end of the −AX side. At the holder 74 located at the end of a +AX side of the axial direction AX (identical to the +X side of the width direction X), a retaining rod 75 penetrating the driving shaft 71 (see FIG. 4) in a direction orthogonal to the axial direction thereof is attached. At the holder 74 located at the end of the −AX side, a retaining ring 76 is attached to the driving shaft 71 so as to be brought into contact with the surface of the holder 74 on the −AX side. Thus, the toothed roller 72 is interposed between the retaining rod 75 and the retaining ring 76 in the axial direction of the driving shaft 71 (axial direction AX), thereby restricting movement of the toothed roller 72 in the axial direction AX relative to the driving shaft 71. In addition, the toothed roller 72 is fixed to the driving shaft 71 so as to be integrally rotatable with the driving shaft 71.

Figure 6:
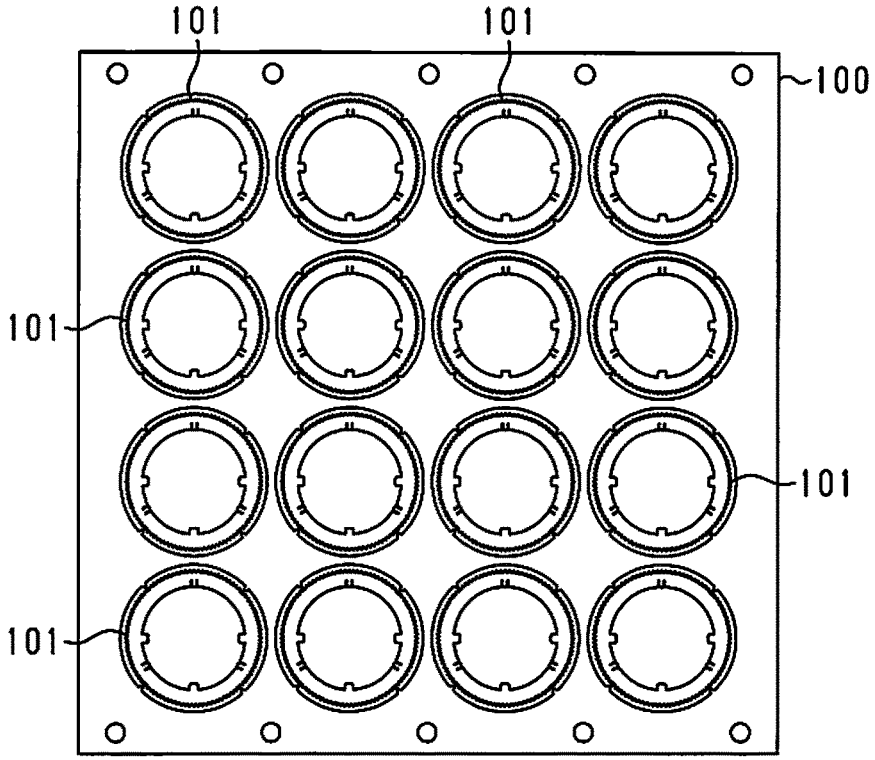
FIG. 6 is a plan view of a base material from which a plurality of wheels are formed.
Figure 7:
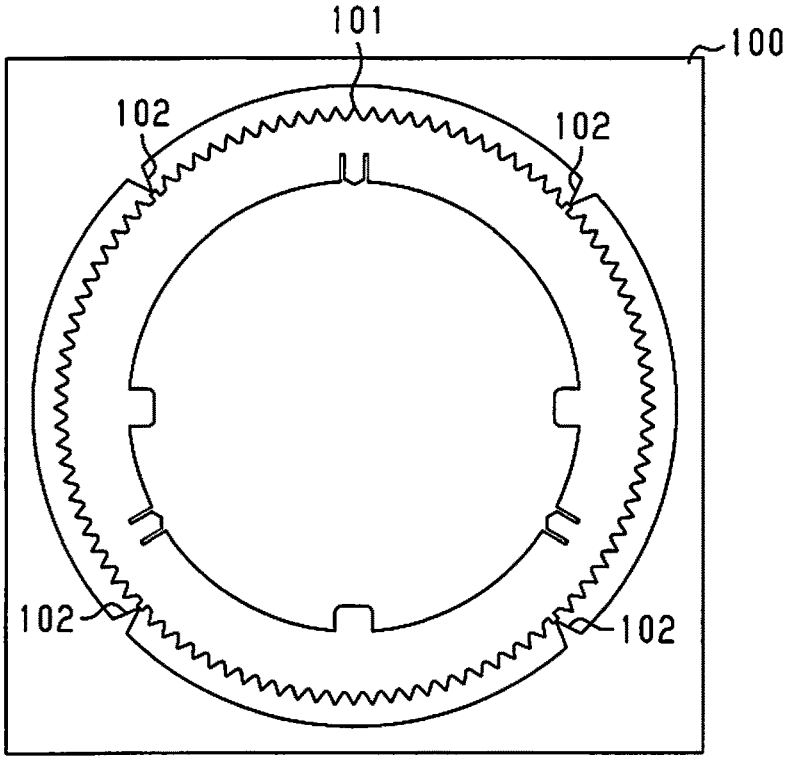
FIG. 7 is a partially enlarged view of FIG. 6.
Figure 8:
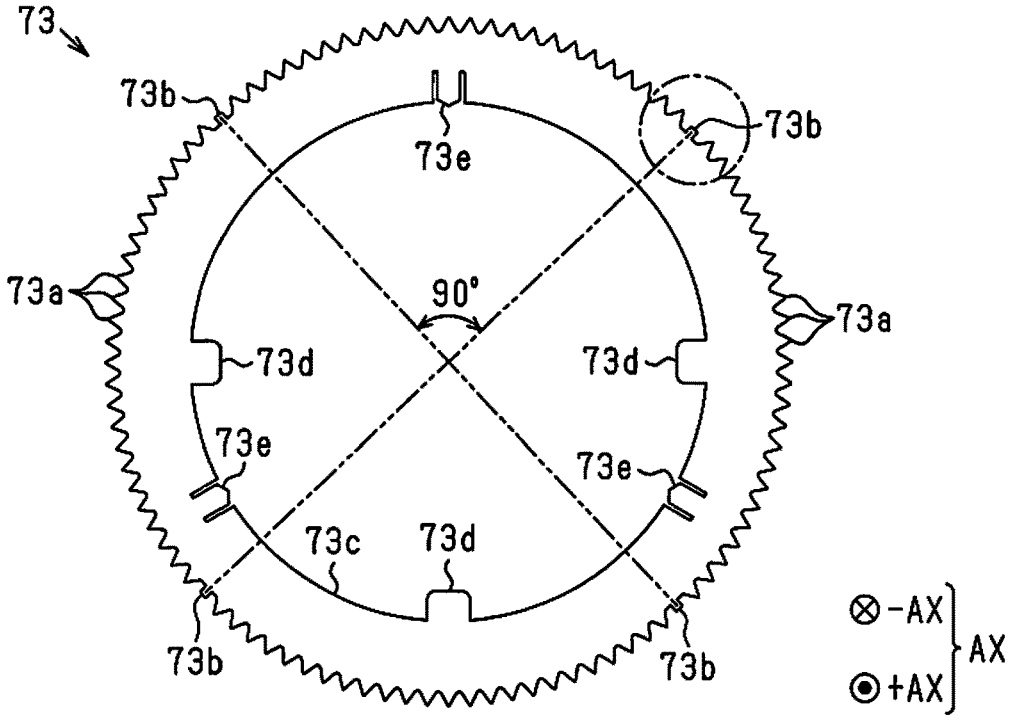
FIG. 8 is a side view of the wheel.

As illustrated in FIG. 6, the plurality of wheels 73 (see FIG. 5) are formed by punching (press working) from a hoop material 100 that serves as a base material and is formed of, for example, a stainless-steel sheet. Specifically, in FIG. 6, for example, sixteen wheel formed products 101 are formed in the hoop material 100 by punching (press working). As illustrated in FIG. 7, the wheel formed product 101 is supported on the hoop material 100 by four tie-bar portions 102. The tie-bar portions 102 of this embodiment are provided at regular intervals, that is, at intervals of 90° in a circumferential direction of the wheel formed product 101, thereby coupling the wheel formed product 101 and the hoop material 100 to each other. The wheel 73 illustrated in FIG. 8 is formed by cutting off the tie-bar portions 102 by a pressing machine. The base material is not limited to the hoop material, and may be a sheet-shaped resin. Herein, the base material may be referred to as a base.

Figure 9:
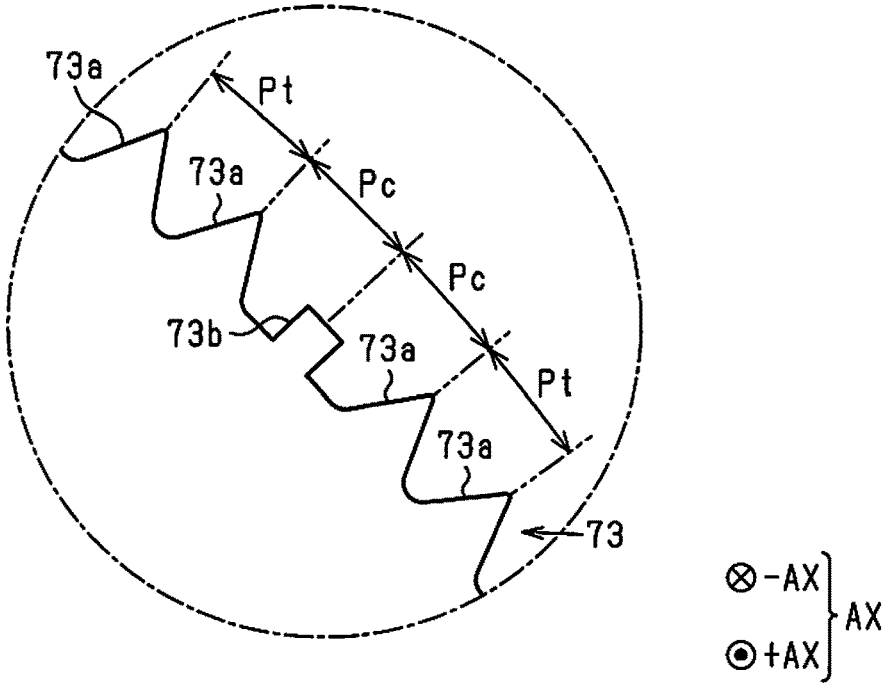
FIG. 9 is a partially enlarged view of FIG. 8.

As illustrated in FIG. 8, on the outer periphery of the wheel 73, teeth 73*a* protruding radially outward are provided contiguously over the entire periphery of the wheel 73. Tie-bar cut portions 73*b* that are cut-off marks of the tie-bar portions 102 are provided on the outer periphery of the wheel 73 at portions corresponding to the tie-bar portions 102 of FIG. 7. Similarly to the tie-bar portions 102, four tie-bar cut portions 73*b* are provided at regular intervals, that is, at intervals of 90° in a circumferential direction of the wheel 73. As illustrated in FIG. 9, the distance in the circumferential direction of the wheel 73 between a tooth 73*a* and another tooth 73*a* adjacent to the tooth 73*a* of interest (hereinafter referred to as "tooth pitch Pt") and a pitch Pc that is the distance between a tie-bar cut portion 73*b* and a tooth 73*a* adjacent to the tie-bar cut portion 73*b* of interest are approximately equal to each other. Therefore, the teeth 73*a* are not formed at the positions where the tie-bar cut portions 73*b* are provided on the outer periphery of the wheel 73. The tip ends of the tie-bar cut portions 73*b* are located on a radially inner side with respect to the tip ends of the teeth 73*a*.

As illustrated in FIG. 8, a hole 73*c* extending through the wheel 73 in the axial direction AX is provided on the inner periphery of the wheel 73. Claws 73*d* extending radially inward are provided at three positions spaced away from each other in the circumferential direction on the inner peripheral edge of the wheel 73 that constitutes the hole 73*c*. At positions different from those of the claws 73*d* on the inner peripheral edge of the wheel 73 that constitutes the hole 73*c*, a plurality of contact pieces 73*e* (three contact pieces 73*e* in this embodiment) oriented radially inward from the inner peripheral edge are formed by cutting out the wheel 73. The plurality of contact pieces 73*e* are provided at regular intervals in the circumferential direction.

Figure 10:
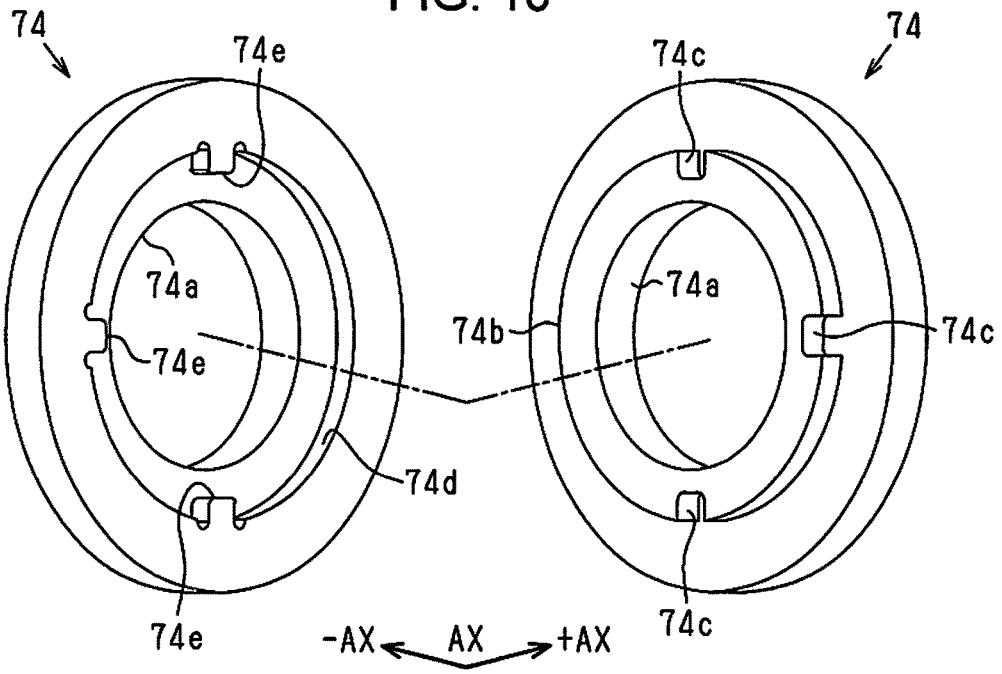
FIG. 10 is a perspective view of two holders.

As illustrated in FIG. 10, a hole 74*a* extending through the holder 74 in the axial direction AX is formed in the holder 74. On the surface of the holder 74 on the side where the wheel 73 (see FIG. 11) is mounted (−AX side), an annular boss 74*b* having an outer diameter smaller than the outer diameter of the holder 74 is formed so as to protrude in the axial direction AX from the inner peripheral edge of the holder 74 that constitutes the hole 74*a*.

That is, the hole 74*a* extends through the boss 74*b*. A plurality of recesses 74*c* (three recesses 74*c* in this embodiment) that are recessed from the outer peripheral surface of the boss 74*b* toward a radially inner side of the holder 74 are formed in the boss 74*b*.

In the six holders 74 other than the holder 74 located at the end of the +AX side (see FIG. 5), depressions 74*d* that are depressed into a circular shape toward the −AX side are formed in the surfaces of the six holders 74 on the +AX side, respectively.

The inner diameter of the depression 74*d* is equal to the outer diameter of the boss 74*b* of the holder 74 adjacent in the axial direction AX. On the inner peripheral surface of the depression 74*d*, a plurality of engagement protrusions 74*e* (three engagement protrusions 74*e* in this embodiment) protrude radially inward in conformity with the recesses 74*c* of the holder 74 adjacent in the axial direction AX. In each of the six holders 74 other than the holder 74 located at the end of the +AX side (see FIG. 5), the positions of the recesses 74*c* in the circumferential direction and the positions of the engagement protrusions 74*e* in the circumferential direction are different from each other.

Figure 11:
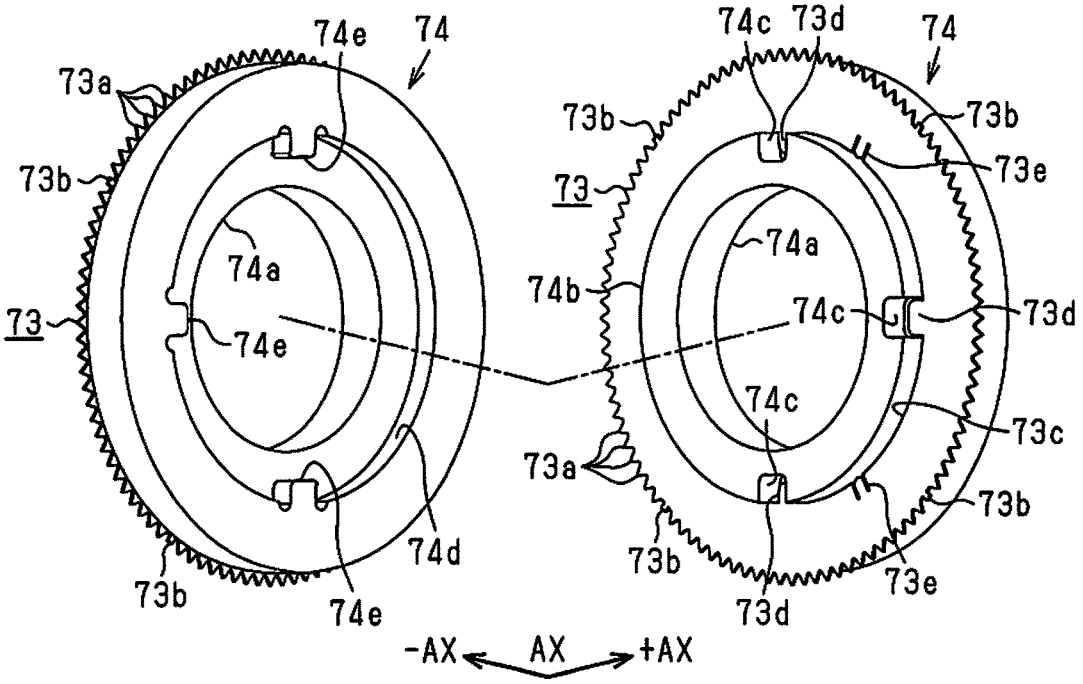
FIG. 11 is a perspective view of the holders having the wheels mounted thereon.

As illustrated in FIG. 11, the wheel 73 is mounted on the holder 74 by fitting the boss 74*b* of the holder 74 to the hole 73*c* of the wheel 73. At this time, the three contact pieces 73*e* of the wheel 73 (FIG. 11 only illustrates the two contact pieces 73*e*) are held in contact with the boss 74*b*. Thus, the looseness of the wheel 73 from the holder 74 is reduced, thereby being capable of improving the precision in the coaxiality between the holder 74 and the wheel 73. Further, the claws 73*d* of the wheel 73 are fitted to the recesses 74*c* of the holder 74. Thus, the orientation of the wheel 73 in the circumferential direction with respect to the holder 74 is determined.

The holder 74 having the wheel 73 mounted thereon is assembled onto the holder 74 adjacent in the axial direction AX. Specifically, the boss 74*b* of the holder 74 on the +AX side of FIG. 11 (right side of the drawing sheet) is fitted to the depression 74*d* of the holder 74 on the −AX side (left side of the drawing sheet). At this time, the engagement protrusions 74*e* of the holder 74 on the −AX side are engaged with the recesses 74*c* of the holder 74 on the +AX side. Thus, the wheel 73 is interposed between the holders 74 adjacent to each other in the axial direction AX.

The toothed roller 72 thus constructed such that the wheels 73 and the holders 74 are stacked in the axial direction AX transports the paper sheet P in such a manner that the tip ends of the teeth 73*a* provided on the peripheral surface of the toothed roller 72 are brought into contact with the paper sheet P. That is, the teeth 73*a* of the toothed roller 72 function as projections configured to be brought into point contact with the paper sheet P. In other words, the wheel 73 includes projections configured to be brought into point contact with the paper sheet P.

Figure 12:
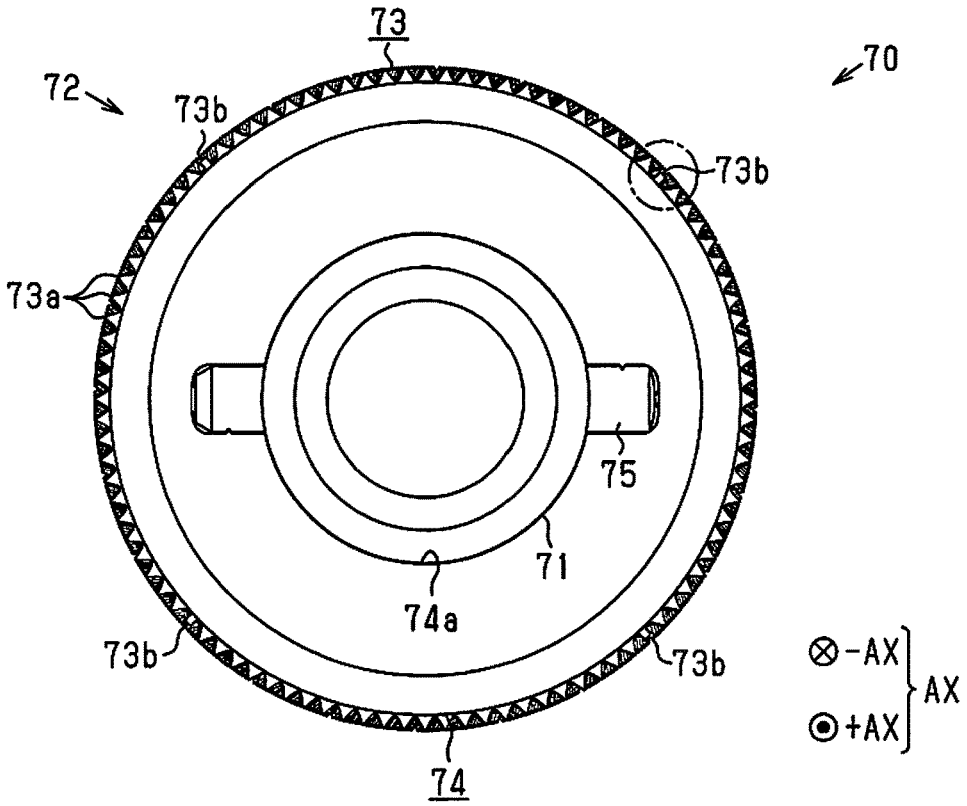
FIG. 12 is a side view of the toothed roller as viewed in an axial direction.
Figure 13:
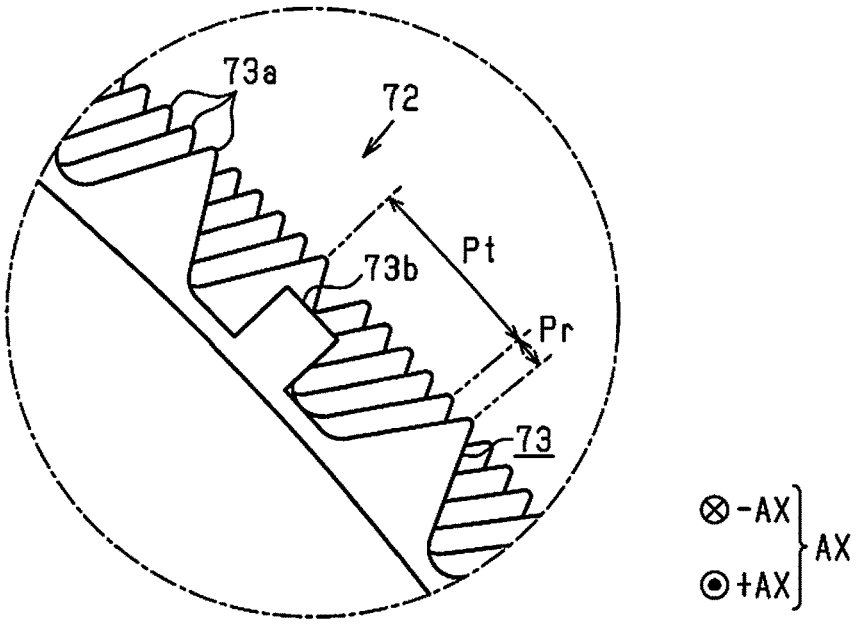
FIG. 13 is an enlarged view of a portion denoted by a chain line circle in FIG. 12.

As illustrated in FIG. 12 and FIG. 13, in the toothed roller 72, the teeth 73*a* are provided while being positionally shifted from each other so that the respective teeth 73*a* do not completely overlap each other on the peripheral surface of the toothed roller 72 when the toothed roller 72 is viewed in the axial direction AX. That is, the teeth 73*a* are arranged so that all the teeth 73*a* provided on the peripheral surface of the toothed roller 72 become visible when the toothed roller 72 is viewed in the axial direction AX. In this embodiment, the teeth 73*a* of the toothed roller 72 are arranged at regular intervals in the circumferential direction when the toothed roller 72 is viewed in the axial direction AX. That is, the teeth 73*a* of five other wheels 73 are arranged so that the tooth pitch Pt that is the distance between the teeth 73*a* adjacent to each other in the circumferential direction of the wheel 73 of interest is divided into six equal parts corresponding to the number of wheels 73.

As understood from FIG. 13, regarding the teeth 73*a* adjacent to the tie-bar cut portion 73*b* on the toothed roller 72, there are portions where the teeth 73*a* cannot be arranged at regular intervals because the tie-bar cut portions 73*b* are located at those portions. In order that the portions where the teeth 73*a* cannot be arranged at regular intervals may maximally be prevented from being distributed unevenly in the circumferential direction of the toothed roller 72, it is only necessary to construct the toothed roller 72 by assembling the plurality of wheels 73 onto the respective holders 74 so that the tie-bar cut portions 73*b* are located away from each other at regular intervals.

Figure 14:
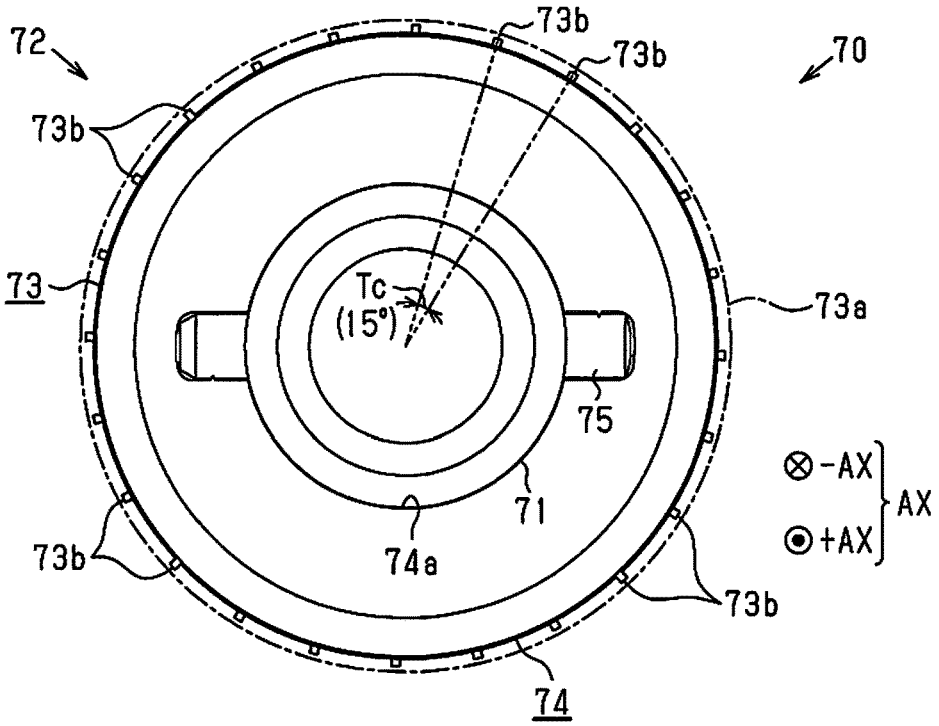
FIG. 14 is a schematic side view of the toothed roller as viewed in the axial direction, for describing operations of the first embodiment.

As illustrated in FIG. 14, in the toothed roller 72, the plurality of tie-bar cut portions 73*b* that are present along the circumferential direction of the toothed roller 72 are provided so as not to be distributed unevenly in the circumferential direction when the toothed roller 72 is viewed in the axial direction AX. Specifically, a distance by which the tie-bar cut portions 73*b* are present contiguously along the circumferential direction of the toothed roller 72 is defined as a first distance, a distance by which the tie-bar cut portions 73*b* are not present contiguously along the circumferential direction of the toothed roller 72 is defined as a second distance, and a distance obtained by dividing the total circumferential distance of the wheel 73 by the number of tie-bar cut portions 73*b* is defined as a third distance.

In this case, the plurality of tie-bar cut portions 73*b* are provided so as to satisfy relationships that the first distance is equal to or larger than the third distance and the second distance is smaller than the third distance.

The first distance and the second distance are described supplementarily.

That is, the first distance refers to a result of investigation that is conducted over the entire circumference of an imaginary circle connecting the vertices of the teeth 73*a* of the wheels 73 regarding a state in which a plurality of tie-bar cut portions 73*b* of the toothed roller 72 are present within a range of a predetermined arc on the imaginary circle. Specifically, when predetermined arcs are sequentially arranged clockwise around the imaginary circle (0° to 30°, 30° to 60°, . . . 330° to 360°), the first distance is a cumulative distance of the predetermined arcs in the state in which a plurality of tie-bar cut portions 73*b* are located within the range of the arc. If a plurality of tie-bar cut portions 73*b* are located within the range of all the arranged arcs, the first distance equals the total circumferential distance of the imaginary circle.

Details of the "predetermined arc" are exemplified.

As a precondition, it is assumed that six wheels 73 each having four tie-bar cut portions 73*b* with a phase difference of 90° (FIG. 8) are adjacent to each other. FIG. 14 (the tie-bar cut portions 73*b* are arranged at regular intervals) illustrates an example of a case in which the precondition is satisfied. As illustrated in FIG. 14, the arrangement of the tie-bar cut portions 73*b* at regular intervals is the best mode. In order to arrange the tie-bar cut portions 73*b* as illustrated in FIG. 14, it is necessary to secure an angle of 15° as a central angle formed between the adjacent tie-bar cut portions 73*b*. Thus, it is preferred that an arc having a central angle of 30° (15°×2) be employed as the predetermined arc.

By employing the above-mentioned predetermined arc (arc having a central angle of 30°), a plurality of tie-bar cut portions are arranged within the range of all or most of the predetermined arcs (arcs each having a central angle of) 30° sequentially arranged along the circumference of the imaginary circle when the tie-bar cut portions 73*b* are arranged at regular intervals as illustrated in FIG. 14 or when the tie-bar cut portions 73*b* are otherwise arranged at intervals close to regular intervals. Thus, it is appropriate to employ the predetermined arc (arc having a central angle of 30°) when measuring the first distance that is the "distance by which the tie-bar cut portions 73*b* are present contiguously along the circumferential direction of the toothed roller 72".

The second distance refers to a result of investigation that is conducted over the entire circumference of an imaginary circle connecting the vertices of the teeth 73*a* of the wheels 73 regarding a state in which a plurality of tie-bar cut portions 73*b* of the toothed roller 72 are not present within a range of a predetermined arc on the imaginary circle. Specifically, when predetermined arcs are sequentially arranged clockwise around the imaginary circle (0° to 30°, 30° to 60°, . . . 330° to 360°), the second distance is a cumulative distance of the predetermined arcs in the state in which a plurality of tie-bar cut portions 73*b* are not located within the range of the arc. Also in this case, an arc having a central angle of 30° is used as the predetermined arc. For example, when the predetermined arcs are sequentially arranged around the imaginary circle of FIG. 14, a plurality of tie-bar cut portions 73*b* are located within the range of all the arcs, and hence the second distance is zero. If the second distance is measured in FIG. 15 in which the tie-bar cut portions 73*b* are distributed unevenly, the second distance has a value larger than zero as a matter of course.

In the toothed roller 72 of this embodiment, the tie-bar cut portions 73*b* are provided at regular intervals in the circumferential direction when the toothed roller 72 is viewed in the axial direction AX. Specifically, in this embodiment, the first distance equals the total circumferential distance of the wheel 73, the second distance equals "0", and the third distance equals a quarter of the total circumferential distance of the wheel 73. In order to satisfy those relationships, a shift amount Tc)(° of the tie-bar cut portions 73*b* of the wheels 73 adjacent to each other in the axial direction AX equals a value obtained by dividing 360° by a value obtained by multiplying the number of wheels 73 and the number of tie-bar cut portions 73*b* together. In this embodiment, the number of wheels 73 is six and the number of tie-bar cut portions 73*b* of the wheel 73 is four, and hence the shift amount Tc is 360°/(6×4)=15°. The shift amount Tc of the tie-bar cut portions 73*b* of the wheels 73 adjacent to each other in the axial direction AX according to this embodiment is defined by a minimum angle between the tie-bar cut portion 73*b* of a wheel 73 and the tie-bar cut portion 73*b* of another wheel 73 adjacent to the wheel 73 of interest in the axial direction AX.

The value of the tooth pitch Pt of the wheel 73 is adjusted (set) so as to achieve an arrangement state in which the plurality of tie-bar cut portions 73*b* that are present along the circumferential direction of the toothed roller 72 are not distributed unevenly and all the teeth 73*a* provided on the peripheral surface of the toothed roller 72 are visible when the toothed roller 72 is viewed in the axial direction AX. In this embodiment, the value of the tooth pitch Pt of the wheel 73 is adjusted (set) so that the tie-bar cut portions 73*b* of the six wheels 73 are provided at regular intervals in the circumferential direction and the teeth 73*a* are provided on the peripheral surface of the toothed roller 72 at a constant pitch Pr (see FIG. 13) in the circumferential direction when the toothed roller 72 is viewed in the axial direction AX. The tooth pitch Pt is calculated based on the following relational expression of the shift amount Tc and the tooth pitch Pt:

$$\text{shift amount } Tc=(N\times Pt)+Pr$$

"N" is a multiple of Pt. "Pr" is defined by Pt/(number of wheels). The tooth pitch Pt of this embodiment is 3.6°, provided that "N" is "4". In this case, the pitch Pr is 0.6° based on the expression of 3.6/6.

In this embodiment, the wheels 73 adjacent to each other in the axial direction AX are shifted from each other by the shift amount Tc by assembling the holders 74 adjacent to each other in the axial direction AX. Specifically, in a single holder 74 illustrated in FIG. 11, the recesses 74*c* formed on the −AX side and the engagement protrusions 74*e* formed on the +AX side are provided so that the positions of the recesses 74*c* in the circumferential direction and the positions of the engagement protrusions 74*e* in the circumferential direction are different from each other in the circumferential direction by the shift amount Tc.

Operations of the toothed roller 72 (correction driving roller 70) having the above-mentioned configuration are described with reference to FIG. 14 and FIG. 15.

Figure 15:
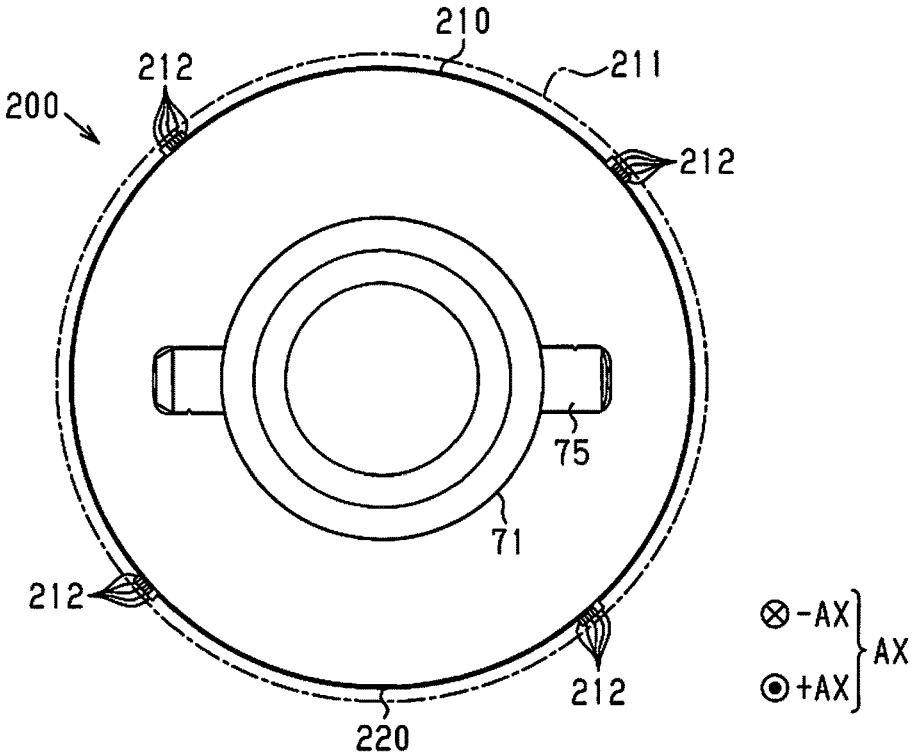
FIG. 15 is a schematic side view of a toothed roller of a comparative example as viewed in the axial direction.

FIG. 15 illustrates the configuration of a toothed roller 200 of a comparative example in which wheels 210 are stacked in the axial direction AX with holders 220 interposed therebetween. In FIG. 14 and FIG. 15, the teeth 73*a* and 211 formed on the outer periphery of the wheels 73 and 210 are omitted but denoted by a chain line circle for convenience of the description. Similarly to the wheel 73, the wheel 210 has four tie-bar cut portions 212.

As illustrated in FIG. 15, in the toothed roller 200 of the comparative example, the plurality of tie-bar cut portions 212 that are present along a circumferential direction of the toothed roller 200 are arranged so as to overlap each other by stacking six wheels 210 in the axial direction AX. That is, the plurality of tie-bar cut portions 212 that are present along the circumferential direction of the toothed roller 200 are arranged densely at four positions on the toothed roller 200 when the toothed roller 200 of the comparative example is viewed in the axial direction AX. In this manner, in the toothed roller 200 of the comparative example, the tie-bar cut portions 212 are provided so as to be distributed unevenly in the circumferential direction of the toothed roller 200. Thus, when the toothed roller 200 of the comparative example is viewed in the axial direction AX, the outer diameter of a portion of the toothed roller 200 where the tie-bar cut portions 212 are distributed unevenly is smaller than the outer diameter of a portion of the toothed roller 200 where the tie-bar cut portions 212 are not present.

As described above, the toothed roller 200 has a distorted shape that differs from a perfect circle when the toothed roller 200 of the comparative example is viewed in the axial direction AX. Thus, when the toothed roller 200 of the comparative example transports the paper sheet P (see FIG. 1), it is difficult to achieve contact between the paper sheet P and the portion of the toothed roller 200 where the tie-bar cut portions 212 are distributed unevenly. Therefore, a force for transporting the paper sheet P at the portion of the toothed roller 200 where the tie-bar cut portions 212 are distributed unevenly is smaller than a force for transporting the paper sheet P at the portion of the toothed roller 200 where the tie-bar cut portions 212 are not present. In this manner, the force for transporting the paper sheet P varies depending on the position on the toothed roller 200 in the circumferential direction, and as a result, the transport accuracy of the paper sheet P is decreased.

In this respect, in the toothed roller 72 of this embodiment, as illustrated in FIG. 14, the plurality of tie-bar cut portions 73*b* that are present along the circumferential direction of the toothed roller 72 are arranged at a constant pitch in the circumferential direction when the toothed roller 72 is viewed in the axial direction AX. That is, the plurality of tie-bar cut portions 73*b* that are present along the circumferential direction of the toothed roller 72 are not distributed unevenly in the circumferential direction. Thus, the shape of the toothed roller 72 is close to a perfect circle. Therefore, when the toothed roller 72 transports the paper sheet P, the variation in the force for transporting the paper sheet P by the toothed roller 72 depending on the position on the toothed roller 72 in the circumferential direction is suppressed. Thus, the decrease in the transport accuracy of the paper sheet P can be suppressed.

Next, a method for manufacturing the correction driving roller 70, which is an example of a method for manufacturing a roller, is described with reference to FIG. 6 to FIG. 8, FIG. 11, FIG. 16, and FIG. 17.

Figure 16:
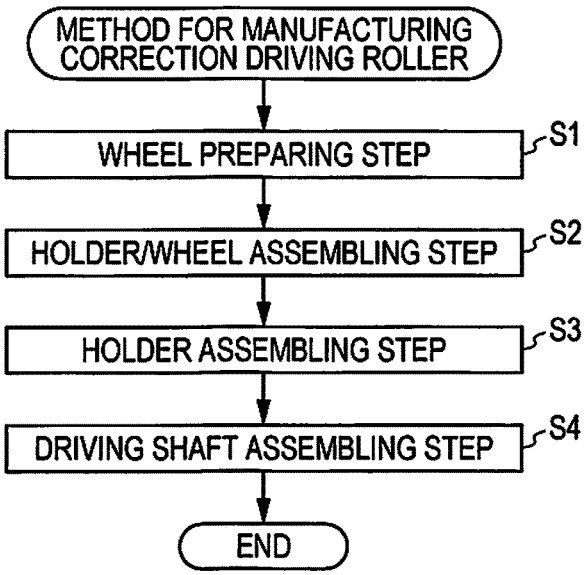
FIG. 16 is a flowchart illustrating steps of a method for manufacturing the correction driving roller.

As illustrated in FIG. 16, the method for manufacturing the correction driving roller 70 includes a wheel preparing step (Step S1), a holder/wheel assembling step (Step S2), a holder assembling step (Step S3), and a driving shaft assembling step (Step S4).

In the wheel preparing step, the plurality of wheel formed products 101 are formed by punching (press working) from the hoop material 100 illustrated in FIG. 6, and then the wheel formed products 101 are cut off from the hoop material 100 by cutting off the tie-bar portions 102 (see FIG. 7) by press working. Thus, the plurality of wheels 73 (see FIG. 8) are formed.

In the holder/wheel assembling step, as illustrated in FIG. 11, the wheel 73 and the holder 74 are assembled by fitting the boss 74*b* of the holder 74 to the hole 73*c* of the wheel 73. In this step, six assemblies of the wheel 73 and the holder 74 are manufactured.

Figure 17:
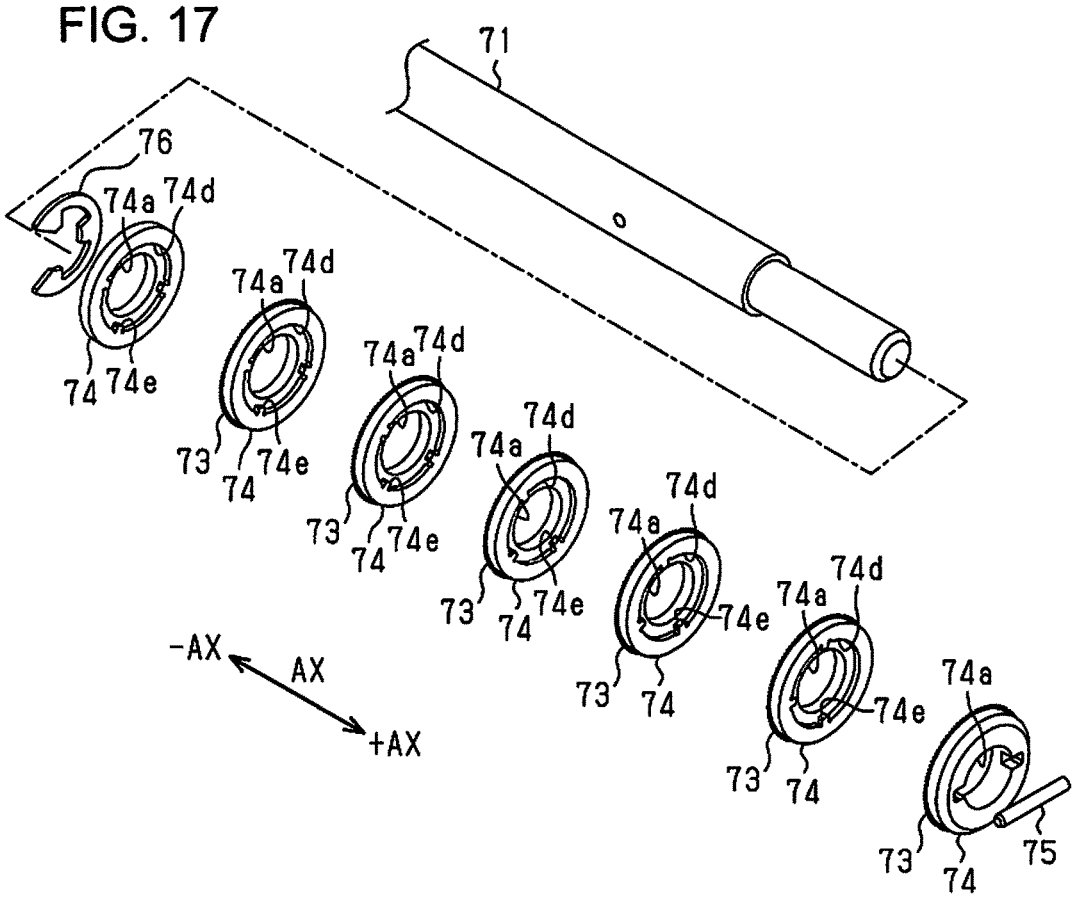
FIG. 17 is an exploded perspective view of a state in which the wheels are mounted on the holders in the state of FIG. 5.

In the holder assembling step, as illustrated in FIG. 17, the six assemblies of the wheel 73 and the holder 74 are stacked in the axial direction AX, and the holder 74 located at the end of the +AX side is assembled thereonto. In this embodiment, the holder 74 is formed so that the positions of the recesses 74*c* (see FIG. 11) of the holder 74 in the circumferential direction and the positions of the engagement protrusions 74*e* (see FIG. 11) of the holder 74 in the circumferential direction are different from each other in the circumferential direction by $15°+\alpha°$ ($\alpha°$ is a shift necessary for securing the pitch Pr formed by the adjacent wheels 73; see FIG. 13; by using the above-mentioned mathematical expression, for example, 0.6° can be employed). Therefore, the wheels 73 assembled onto the holders 74 adjacent to each other in the axial direction AX are shifted from each other in the circumferential direction by $15°+\alpha°$. In this manner, the toothed roller 72 is manufactured.

In the driving shaft assembling step, as illustrated in FIG. 17, the toothed roller 72 is fixed to the driving shaft 71. Then, the retaining rod 75 is assembled onto the driving shaft 71 and the holder 74 located at the end of the +AX side of the roller assembly, and the retaining ring 76 is assembled onto the driving shaft 71 so as to be brought into contact with the end surface of the holder 74 in the axial direction AX, which is located at the end of the −AX side of the roller assembly. Then, the remaining nine toothed rollers 72 are manufactured similarly, and in the driving shaft assembling step, the nine toothed rollers 72 are assembled onto the driving shaft 71. In this manner, the correction driving roller 70 is manufactured.

According to this embodiment, the following advantages can be obtained.

(1) The plurality of tie-bar cut portions 73*b* that are present along the circumferential direction of the toothed roller 72 are not distributed unevenly in the circumferential direction when the toothed roller 72 is viewed in the axial direction AX, thereby being capable of reducing the occurrence of a case in which the shape of the toothed roller 72 differs from a perfect circle when the toothed roller 72 is viewed in the axial direction AX. Thus, the decrease in the transport accuracy of the paper sheet P to be transported by the toothed roller 72 (correction roller pair 60) can be suppressed.

(2) The plurality of tie-bar cut portions 73*b* are provided so that the first distance by which the tie-bar cut portions 73*b* are present contiguously along the circumferential direction of the toothed roller 72 is equal to or larger than the third distance obtained by dividing the total circumferential distance of the wheel 73 by the number of tie-bar cut portions 73*b*, and the second distance by which the tie-bar cut portions 73*b* are not present contiguously along the circumferential direction of the toothed roller 72 is smaller than the third distance. According to this configuration, the plurality of tie-bar cut portions 73*b* that are present along the circumferential direction of the toothed roller 72 are not distributed unevenly in the circumferential direction when the toothed roller 72 is viewed in the axial direction AX. Thus, the decrease in the transport accuracy of the paper sheet P to be transported by the toothed roller 72 (correction roller pair 60) can be suppressed.

In particular, in this embodiment, the plurality of tie-bar cut portions 73*b* that are present along the circumferential direction of the toothed roller 72 are arranged at a constant pitch in the circumferential direction when the toothed roller 72 is viewed in the axial direction AX. That is, the second distance equals "0". Therefore, the shape of the toothed roller 72 is even closer to a perfect circle. Thus, the decrease in the transport accuracy of the paper sheet P to be transported by the toothed roller 72 can further be suppressed.

(3) The plurality of toothed rollers 72 that are reduced in terms of the occurrence of the case in which the shapes of the toothed rollers 72 differ from a perfect circle when the toothed rollers 72 are viewed in the axial direction AX are fixed to the driving shaft 71 while being arrayed in the axial direction AX (width direction X). According to this configuration, when the plurality of toothed rollers 72 fixed to the driving shaft 71 transport the paper sheet P, the variation in the transport accuracy of the paper sheet P in the width direction X of the paper sheet P along the axial direction of the driving shaft 71 can be suppressed.

(4) The teeth 73*a* of the wheels 73 of the toothed roller 72 are arranged so as to be positionally shifted from each other in the circumferential direction of the toothed roller 72 when the toothed roller 72 is viewed in the axial direction AX. This configuration reduces a risk that the leading edge of the paper sheet P that abuts the toothed roller 72 may enter the space between the teeth 73*a* on the peripheral surface of the toothed roller 72 compared with a configuration assumed such that the teeth 73*a* are provided on the peripheral surface of the toothed roller 72 so as to be arrayed linearly in the axial direction AX (width direction X) when the toothed roller 72 is viewed in the axial direction AX. Therefore, the decrease in the transport accuracy of the paper sheet P can be suppressed.

(5) The reduction in the occurrence of the case in which the shapes of the toothed rollers 72 which the leading edge of the paper sheet P abuts differ from a perfect circle when the toothed rollers 72 are viewed in the axial direction AX leads to a reduction in the occurrence of a case in which the position of the leading edge of the paper sheet P in the transport direction Y, which abuts the toothed roller 72, varies in the width direction X. Thus, the correction roller pair 60 (correction driving roller 70) including the toothed rollers 72 can accurately correct the skew feed of the paper sheet P.

Second Embodiment

A printing apparatus 10 of a second embodiment is described with reference to FIG. 18 and FIG. 19. The printing apparatus 10 of this embodiment is different from the printing apparatus 10 of the first embodiment in terms of the arrangement positions of the tie-bar cut portions 73*b* of the wheel 73.

Figure 18:
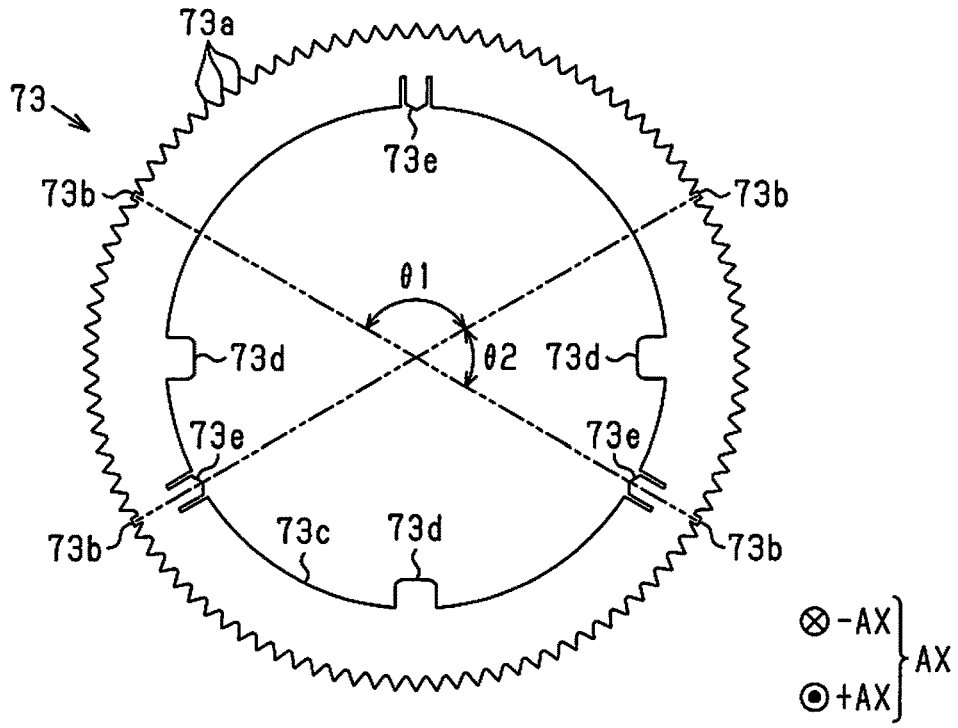
FIG. 18 is a side view of a wheel constituting a toothed roller of a second embodiment.

As illustrated in FIG. 18, the four tie-bar cut portions 73*b* of the wheel 73 are not arranged at regular intervals in the circumferential direction of the wheel 73. Specifically, an angle θ1 formed about the center of the wheel 73 between one tie-bar cut portion 73*b* and another tie-bar cut portion 73*b* adjacent to the one tie-bar cut portion 73*b* on one side in the circumferential direction of the wheel 73 and an angle θ2 formed about the center of the wheel 73 between the one tie-bar cut portion 73*b* and still another tie-bar cut portion 73*b* adjacent to the one tie-bar cut portion 73*b* on the other side in the circumferential direction of the wheel 73 are different from each other. In the wheel 73 illustrated in FIG. 18, a relationship of angle θ1>angle θ2 holds.

In the toothed roller 72 (see FIG. 19) constructed such that the wheels 73 described above are stacked in the axial direction AX, the shift amount Tc of the wheels 73 adjacent to each other in the axial direction AX is set as follows. That is, the shift amount Tc is set to a value that is capable of exactly dividing 360° corresponding to the circumference of the wheel 73 and is incapable of exactly dividing the angle θ1 and the angle θ2. In this embodiment, the angle θ1 is "120°" and the angle θ2 is "60°", and hence the shift amount Tc is 9°×N (N is a natural number). "N" can be set arbitrarily, and the value of "N" is set to 2 or larger, for example, when the number of wheels 73 is limited (that is, when the number of wheels 73 may exceed the upper limit value as long as the shift amount Tc is 9°). Further, the value of "N" is set so that the first distance by which the tie-bar cut portions 73*b* are present contiguously along the circumferential direction of the toothed roller 72 is equal to or larger than the third distance obtained by dividing the total circumferential distance of the wheel 73 by the number of tie-bar cut portions 73*b*, and the second distance by which the tie-bar cut portions 73*b* are not present contiguously along the circumferential direction of the toothed roller 72 is smaller than the third distance.

Figure 19:
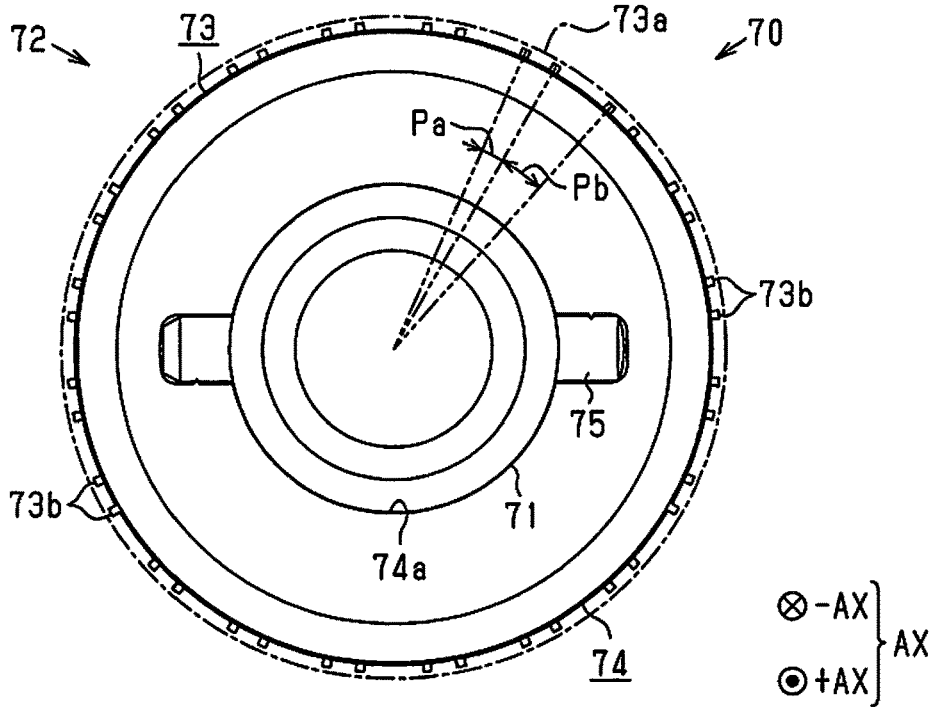
FIG. 19 is a schematic side view of the toothed roller as viewed in the axial direction.

FIG. 19 illustrates an example of arrangement of the tie-bar cut portions 73*b* of the toothed roller 72 in a case of the shift amount Tc of 18°, that is, in a case of "N=2". As illustrated in FIG. 19, the tie-bar cut portions 73*b* are arranged at two types of pitches Pa and Pb over the entire periphery of the toothed roller 72, and the difference between the pitches Pa and Pb is small. Therefore, the tie-bar cut portions 73*b* are arranged approximately evenly in the circumferential direction of the wheel 73. Thus, the first distance by which the tie-bar cut portions 73*b* are present contiguously along the circumferential direction of the toothed roller 72 equals the total circumferential distance of the wheel 73, and the second distance by which the tie-bar cut portions 73*b* are not present contiguously along the circumferential direction of the toothed roller 72 equals "0". Further, the third distance obtained by dividing the total circumferential distance of the wheel 73 by the number of tie-bar cut portions 73*b* equals a quarter of the total circumferential distance of the wheel 73. As described above, even if the four tie-bar cut portions 73*b* of the wheel 73 are provided at irregular intervals in the circumferential direction, the plurality of tie-bar cut portions 73*b* are not distributed unevenly in the circumferential direction when the toothed roller 72 is viewed in the axial direction AX.

Accordingly, advantages similar to the advantages of the first embodiment can be obtained.

MODIFIED EXAMPLES

The embodiments described above may be modified as in the following modified examples. The embodiments and the modified examples may be combined arbitrarily.

In the first embodiment, the tie-bar cut portions 73*b* adjacent to each other in the axial direction AX need not be arranged at regular intervals in the circumferential direction over the entire periphery of the wheel 73 when the toothed roller 72 is viewed in the axial direction AX. Specifically, the shift amount Tc may have such a value that 360° is not exactly divisible in a mathematical expression represented by shift amount Tc=360°/(number of tie-bar cut portions 73*b*×number of wheels 73). As an example thereof, when the number of wheels 73 is seven, the shift amount Tc is 12.8° with a remainder of 1.6° based on the expression of 360/(4×7). Therefore, the shift amount Tc of the six wheels 73 is set to 12.8°, and the shift amount Tc of the remaining one wheel 73 is set to 14.4° (=12.8+1.6). Also in this case, the plurality of tie-bar cut portions 73*b* that are present along the circumferential direction of the toothed roller 72 are not distributed unevenly in the circumferential direction when the toothed roller 72 is viewed in the axial direction AX.

Further, the shift amount Tc of a plurality of wheels 73 may be set different from the shift amount Tc of the other wheels 73 instead of the case in which the shift amount Tc of one wheel 73 is set different from the shift amount Tc of the other wheels 73. For example, the shift amount Tc of the five wheels 73 is set to 12.8°, and the shift amount Tc of the remaining two wheels 73 is set to 13.6° (=12.8+1.6/2). Thus, the number of tie-bar cut portions 73*b* which are not arranged at regular intervals in the circumferential direction of the wheel 73 increases, but the amount of deviation between the positions of the tie-bar cut portions 73*b* which are arranged at regular intervals in the circumferential direction and the positions of the tie-bar cut portions 73*b* which are not arranged at regular intervals in the circumferential direction decreases.

Figure 20:
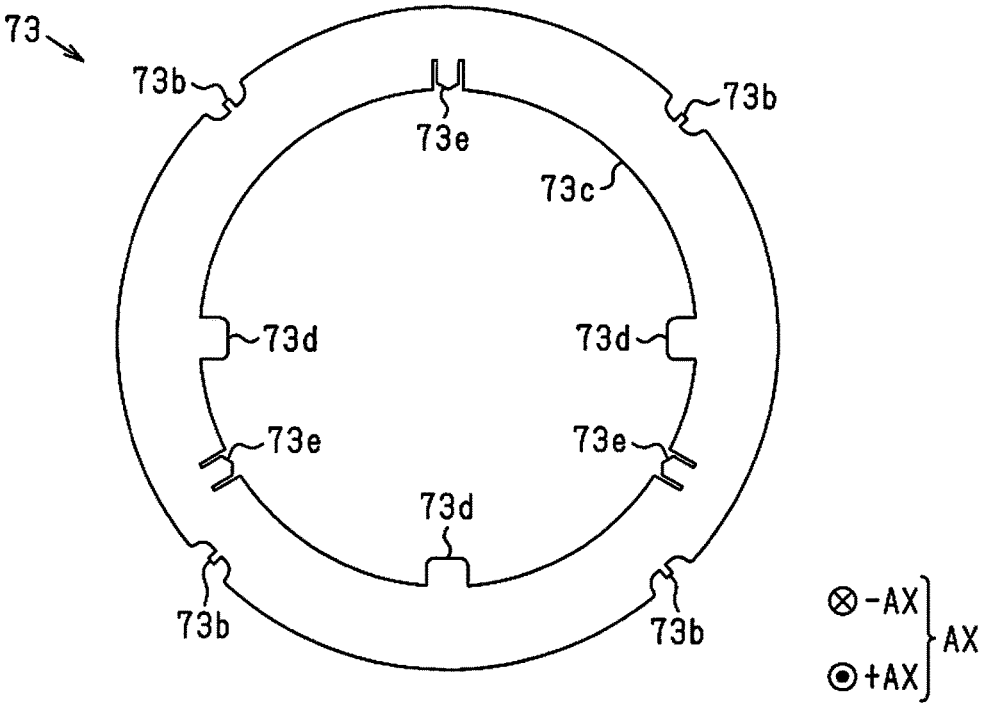
FIG. 20 is a side view of a wheel of a modified example.

In the embodiments described above, the roller other than the correction driving roller 70 may also be constructed such that the plurality of wheels 73 and the plurality of holders 74 are assembled as in the toothed roller 72. In this case, as illustrated in FIG. 20, the teeth 73*a* may be omitted from the wheel 73. The tie-bar cut portions 73*b* of the wheel 73 from which the teeth 73*a* are omitted are located on a radially inner side of the wheel 73 with respect to the outer peripheral surface of the wheel 73. In FIG. 20, four tie-bar cut portions 73*b* are provided at regular intervals in the circumferential direction similarly to the wheel 73 of the first embodiment. The four tie-bar cut portions 73*b* may be arranged at irregular intervals in the circumferential direction similarly to the wheel 73 of the second embodiment. The wheel 73 from which the teeth 73*a* are omitted as illustrated in FIG. 20 may also be used for the correction driving roller 70.

Figure 21:
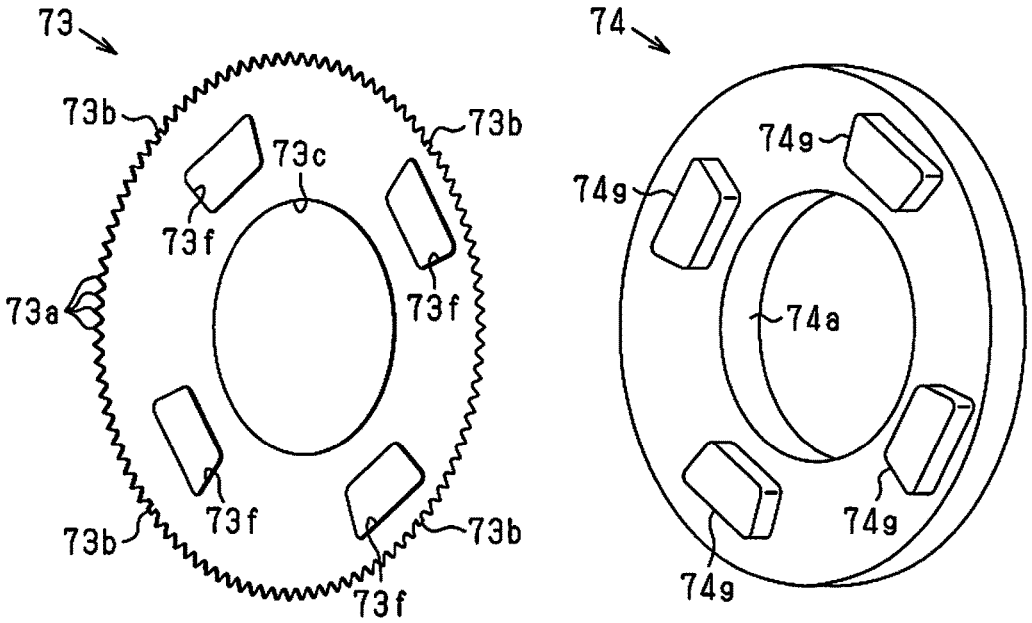
FIG. 21 is a perspective view of a wheel and a holder of another modified example.

In the embodiments described above, the shapes for achieving the fitting between the wheel 73 and the holder 74 may be changed. As an example, as illustrated in FIG. 21, four fitting holes 73*f* are formed in the wheel 73 with intervals in the circumferential direction of the wheel 73. The four fitting holes 73*f* are arranged at regular intervals in the circumferential direction of the wheel 73. It is preferred that the inner diameter of the hole 73*c* of the wheel 73 illustrated in FIG. 21 be equal to or larger than the inner diameter of the hole 74*a* of the holder 74. The holder 74 is provided with four protruding portions 74*g* in place of the boss 74*b* (see FIG. 10). The wheel 73 and the holder 74 are assembled by fitting the four protruding portions 74*g* of the holder 74 to the four fitting holes 73*f* of the wheel 73, respectively. The number of fitting holes 73*f* and the number of protruding portions 74*g* may be set arbitrarily.

In the embodiments described above, the teeth 73*a* of the wheels 73 of the toothed roller 72 need not be arranged while being shifted from each other so that all the teeth 73*a* become visible on the peripheral surface of the toothed roller 72 when the toothed roller 72 is viewed in the axial direction AX. For example, the teeth 73*a* of a predetermined wheel 73 may be arranged so as to completely overlap the teeth 73*a* of another wheel 73.

In the embodiments described above, the number of tie-bar cut portions 73*b* may be set arbitrarily.

It is preferred that the number of tie-bar portions 102 be equal to or larger than three so that the wheel formed products 101 are held on the hoop material 100 with good balance. Therefore, it is preferred that the number of tie-bar cut portions 73*b* be equal to or larger than three.

In the embodiments described above, in order that the tie-bar cut portions 73*b* of the plurality of toothed rollers 72 arrayed in the axial direction AX (width direction X) are not distributed unevenly, the positions of the plurality of toothed rollers 72 in the circumferential direction may be adjusted (set). For example, when the tie-bar cut portions 73*b* adjacent to each other in the axial direction AX on the ten toothed rollers 72 are shifted from each other in the circumferential direction of the toothed rollers 72 by 15° as in the first embodiment, the positions of the adjacent toothed rollers 72 in the circumferential direction are adjusted (set) so as to be shifted from each other by 1.5°. In short, the shift amount of the adjacent toothed rollers 72 in the circumferential direction is adjusted (set) to a value obtained by dividing the shift amount Tc of the tie-bar cut portions 73*b* of a single toothed roller 72 by the number of toothed rollers 72. According to this configuration, the occurrence of the case in which the tie-bar cut portions 73*b* overlap each other in the axial direction AX (width direction X) is also reduced between the plurality of toothed rollers 72 arrayed in the axial direction AX (width direction X). Thus, the decrease in the transport accuracy of the paper sheet P can further be suppressed.

In the embodiments described above, the plurality of tie-bar cut portions 73*b* that are present along the circumferential direction of the toothed roller 72 need not be provided over the entire periphery when the toothed roller 72 is viewed in the axial direction AX. That is, a region where the tie-bar cut portions 73*b* are not present contiguously along the circumferential direction of the toothed roller 72 may be formed when the toothed roller 72 is viewed in the axial direction AX. In this case, the circumferential distance of the region where the tie-bar cut portions 73*b* are not present contiguously along the circumferential direction of the toothed roller 72 (second distance) is smaller than the third distance obtained by dividing the total circumferential distance of the wheel 73 by the number of tie-bar cut portions 73*b*. In short, it is only necessary to satisfy the relationships that the first distance by which the tie-bar cut portions 73*b* are present contiguously along the circumferential direction of the toothed roller 72 is equal to or larger than the third distance, and the second distance by which the tie-bar cut portions 73*b* are not present contiguously along the circumferential direction of the toothed roller 72 is smaller than the third distance.

In the embodiments described above, the number of toothed rollers 72 may be set arbitrarily. In short, the correction driving roller 70 only needs to have at least one toothed roller 72.

In the embodiments described above, some of the plurality of toothed rollers 72 of the correction driving roller 70 may be provided so that the plurality of tie-bar cut portions 73*b* that are present along the circumferential direction of the toothed rollers 72 are distributed unevenly when the toothed rollers 72 are viewed in the axial direction AX. That is, at least one of the plurality of toothed rollers 72 of the correction driving roller 70 only needs to be provided so that the plurality of tie-bar cut portions 73*b* that are present along the circumferential direction of the toothed roller 72 are not distributed unevenly when the toothed roller 72 is viewed in the axial direction AX. In other words, at least one toothed roller 72 of the correction driving roller 70 only needs to satisfy the relationships that the first distance by which the tie-bar cut portions 73*b* are present contiguously along the circumferential direction of the toothed roller 72 is equal to or larger than the third distance, and the second distance by which the tie-bar cut portions 73*b* are not present contiguously along the circumferential direction of the toothed roller 72 is smaller than the third distance.

In the embodiments described above, the printing apparatus 10 is not limited to the configuration having the printing function alone, and may be a multifunction peripheral.

In the embodiments described above, the printing section 12 may be a serial head that is movable along the width direction X.

In the embodiments described above, the medium to be subjected to printing by the printing section 12 is not limited to a sheet of paper such as the paper sheet P, and may be continuous paper, a resin film, metal foil, a metal film, a composite film (laminated film) of resin and metal, woven fabric, nonwoven fabric, a ceramic sheet, or the like.

In the embodiments described above, a support table that supports the paper sheet P may be provided in place of the transport belt 38 facing the printing section 12.

The recording agent to be used for printing may be a fluid other than ink (a liquid, a liquid-like substance obtained by dispersing or mixing particles of functional materials in a liquid, a fluid-like substance such as a gel, or a substance containing a solid that is ejectable as a fluid). For example, printing may be performed by ejecting a liquid-like substance containing a dispersed or dissolved material such as an electrode material or a color material (pixel material) to be used for manufacturing liquid crystal displays, electroluminescence (EL) displays, and surface-emitting displays.

The printing apparatus 10 may be a fluid-like substance ejecting apparatus that ejects a fluid-like substance such as a gel (for example, a physical gel), or a granular substance ejecting apparatus (for example, a toner jet recording apparatus) that ejects a solid as typified by powder (granular substance) such as toner. Herein, the "fluid" is a concept which excludes a fluid composed of gas alone, and encompasses, for example, a liquid (including an inorganic solvent, an organic solvent, a solution, a liquid resin, and a liquid metal (molten metal)), a liquid-like substance, a fluid-like substance, and a granular substance (including granules and powder).

The printing apparatus 10 is not limited to the apparatus that performs printing on a medium such as the paper sheet P by directly ejecting liquid onto the medium, and may be an apparatus that performs planographic printing, relief printing, intaglio printing, screen printing, or the like, in which liquid applied to a printing plate is transferred onto a medium.

As explained above, a printing apparatus according to an aspect of the invention includes a transport roller that transports a medium. The transport roller includes a shaft that extends in a direction intersecting a transport direction of the medium, and a wheel group in which a plurality of toothed wheels arrayed in the direction in which the shaft extends are held by holders. The toothed wheel includes non-formation portions having no teeth. The non-formation portions of the plurality of toothed wheels of the wheel group are arranged with a phase difference therebetween in a circumferential direction of the toothed wheels.

This configuration reduces the occurrence of a case in which the shape of the wheel group to be brought into contact with the medium differs from a perfect circle when the wheel group is viewed in an axial direction. Thus, the medium can be transported stably.

In the printing apparatus, the non-formation portions may be cut portions that are formed when the toothed wheel is cut off from a base.

According to this configuration, a toothed wheel having high shape precision can be manufactured.

In the printing apparatus, the teeth other than the teeth adjacent to the cut portions may be arranged away from each other at regular intervals in a circumferential direction of the wheel group.

According to this configuration, a transport force can uniformly be transferred to the medium compared with a configuration in which the teeth are provided on the peripheral surface of the wheel group so as to be arrayed linearly in the axial direction when the wheel group is viewed in the direction intersecting the transport direction of the medium. Therefore, the decrease in the transport accuracy of the medium can be suppressed.

In the printing apparatus, the wheel group may satisfy the following relationships between a first distance, a second distance, and a third distance, which are measured when the wheel group is viewed in the direction intersecting the transport direction: first distance third distance and second distance<third distance. In the expression, the first distance is a cumulative distance of arcs in a state in which a plurality of the cut portions are present within a range of each of the arcs when the arcs are arranged without overlapping each other along a circumference of an imaginary circle connecting vertices of the teeth of the toothed wheel. The arcs each have a predetermined central angle along the circumference. The second distance is a cumulative distance of the arcs in a state in which a plurality of the cut portions are not present within the range of each of the arcs when the arcs are arranged without overlapping each other along the circumference. The third distance is a distance obtained by dividing a total circumferential distance of the toothed wheel by the number of the cut portions of one of the toothed wheels.

According to this configuration, the first distance is equal to or larger than the third distance and the second distance is smaller than the third distance, thereby being capable of reducing the occurrence of a case in which the cut portions are distributed unevenly in the circumferential direction of the wheel group when the wheel group is viewed in the direction intersecting the transport direction of the medium. Thus, the decrease in the transport accuracy of the medium to be transported by the roller can be suppressed.

In the printing apparatus, the wheel group may include six toothed wheels as the toothed wheels, and that, when four cut portions are provided with a phase difference of 90° as the cut portions of each of the toothed wheels, the central angle of the arc be 30°.

This configuration can reduce the occurrence of the case in which the cut portions are distributed unevenly in the circumferential direction of the wheel group when the wheel group is viewed in the axial direction. Thus, the decrease in the transport accuracy of the medium to be transported by the roller can be suppressed.

In the printing apparatus, the non-formation portions may be arranged away from each other at regular intervals in a circumferential direction of the wheel group.

According to this configuration, the cut portions are not distributed unevenly in the circumferential direction of the wheel group when the wheel group is viewed in the direction intersecting the transport direction of the medium. Thus, the decrease in the transport accuracy of the medium to be transported by the roller can be suppressed.

In the printing apparatus, the toothed wheel may include a wheel through hole through which the shaft extends, and a wheel projection that extends from a peripheral edge of the wheel through hole toward a center of an imaginary circle connecting vertices of the teeth of the toothed wheel. Further, the holder may include a through hole through which the shaft extends, a boss that is formed on one side surface of the holder so as to be located on an inner side with respect to an outer periphery defined by an edge of the holder in a circumferential direction thereof and so as to extend in the direction intersecting the transport direction, a recess that is formed on the one side surface of the holder so as to be recessed inward from the outer periphery side in the boss and so as to be engaged with the wheel projection, a surface that is formed on the one side surface of the holder so as to be located on the outer periphery side with respect to the boss and so as to support a side surface of a first toothed wheel, a depression that is formed on another side surface of the holder so as to be located on an inner side with respect to the outer periphery and so as to be depressed in the direction intersecting the transport direction for engagement with the boss of another holder, a projection that is formed on the another side surface of the holder so as to extend from the depression on the inner side toward a center of the outer periphery and so as to be engaged with the recess of another holder in a state in which the wheel projection of a second toothed wheel different from the first toothed wheel is engaged with the recess, and a surface that is formed on the another side surface of the holder so as to be located on the outer periphery side with respect to the depression and so as to support a side surface of the second toothed wheel. Further, the projection and the recess of one of the holders may be formed with a phase difference therebetween in the circumferential direction of the holder when the holder is viewed in the direction intersecting the transport direction.

This configuration can facilitate the assembling of a wheel group having the cut portions shifted from each other in the circumferential direction of the wheel group when the wheel group is viewed in the direction intersecting the transport direction of the medium.

In the printing apparatus, the transport roller may be constructed such that a plurality of the wheel groups are fixed to the shaft while being arrayed along the shaft.

According to this configuration, a registration roller that uses the toothed wheels can be manufactured simply while facilitating quality control of the registration roller. Moreover, when the plurality of wheel groups fixed to the rotary shaft transport the medium, a variation in the transport accuracy of the medium in a width direction of the medium in the axial direction of the rotary shaft can be suppressed.

The printing apparatus may be an ink jet printing apparatus, and that the transport roller may be a registration roller that corrects skew feed of the medium.

This configuration reduces the occurrence of a case in which the position of the medium in the transport direction, which abuts the wheel group, varies in the width direction of the medium, which is the direction intersecting the transport direction of the medium. Thus, the registration roller can accurately correct the skew feed of the medium. Moreover, by employing this registration roller in the ink jet printing apparatus, transfer of ink onto the registration roller can be reduced. Particularly in duplex printing, when printing is performed on a first surface and then on a second surface opposite the first surface by reversing the medium, the first surface subjected to printing faces the registration roller, and as a result, undried ink is susceptible to being transferred onto the registration roller. The contact area of the toothed roller is smaller than that of general registration rollers, and as a result, the transfer of ink onto the registration roller can be reduced.

What is claimed is:

1. A transport roller for a transport apparatus that transports a medium, wherein the transport roller includes:

a shaft; and a wheel group in which a plurality of toothed wheels arrayed in a direction in which the shaft extends are held by holders, wherein the toothed wheel includes non-formation portions having no teeth, wherein the non-formation portions of the plurality of toothed wheels of the wheel group are shifted in position from each other in a circumferential direction of the toothed wheels when the wheel group is viewed in the direction in which the shaft extends, wherein the non-formation portions are cut portions that are formed when the toothed wheel is cut off from a base, and wherein the teeth other than the teeth adjacent to the cut portions are arranged away from each other at regular intervals in a circumferential direction of the wheel group.

2. The transport roller according to claim 1, wherein the wheel group satisfies the following relationships between a first distance, a second distance, and a third distance, which are measured when the wheel group is viewed in the direction in which the shaft extends:

first distance ≥third distance; and second distance <third distance, where the first distance is a cumulative distance of arcs in a state in which a plurality of the cut portions are present within a range of each of the arcs when the arcs are arranged without overlapping each other along a circumference of an imaginary circle connecting vertices of the teeth of the toothed wheel, the arcs each having a predetermined central angle along the circumference, the second distance is a cumulative distance of the arcs in a state in which a plurality of the cut portions are not present within the range of each of the arcs when the arcs are arranged without overlapping each other along the circumference, and the third distance is a distance obtained by dividing a total circumferential distance of the toothed wheel by the number of the cut portions of one of the toothed wheels.

3. The transport roller according to claim 2, wherein the wheel group includes six toothed wheels as the toothed wheels, and wherein, when four cut portions are provided with an interval of 90° as the cut portions of each of the toothed wheels, the central angle of the arc is 30°.

4. The transport roller according to claim 1, wherein the non-formation portions are arranged away from each other at regular intervals in a circumferential direction of the wheel group.

5. The transport roller according to claim 1, wherein the toothed wheel includes:

a wheel through hole through which the shaft extends; and a wheel projection that extends from a peripheral edge of the wheel through hole toward a center of an imaginary circle connecting vertices of the teeth of the toothed wheel, wherein the holder includes:

a through hole through which the shaft extends;

a boss that is formed on one side surface of the holder so as to be located on an inner side with respect to an outer periphery defined by an edge of the holder in a circumferential direction thereof and so as to extend in the direction in which the shaft extends;

a recess that is formed on the one side surface of the holder so as to be recessed inward from the outer periphery side in the boss and so as to be engaged with the wheel projection;

a surface that is formed on the one side surface of the holder so as to be located on the outer periphery side with respect to the boss and so as to support a side surface of a first toothed wheel;

a depression that is formed on another side surface of the holder so as to be located on an inner side with respect to the outer periphery and so as to be depressed in the direction in which the shaft extends for engagement with the boss of another holder;

a projection that is formed on the another side surface of the holder so as to extend from the depression on the inner side toward a center of the outer periphery and so as to be engaged with the recess of another holder in a state in which the wheel projection of a second toothed wheel different from the first toothed wheel is engaged with the recess; and a surface that is formed on the another side surface of the holder so as to be located on the outer periphery side with respect to the depression and so as to support a side surface of the second toothed wheel, and wherein the projection and the recess of one of the holders are formed with an interval therebetween in the circumferential direction of the holder when the holder is viewed in the direction in which the shaft extends.

6. The transport roller according to claim 5, wherein the transport roller is constructed such that a plurality of the wheel groups are fixed to the shaft while being arrayed along the shaft.

7. The transport roller according to claim 6, wherein the transport apparatus is an ink jet printing apparatus, and wherein the transport roller is a registration roller that corrects skew feed of the medium.

8. A transport roller for a printing transport apparatus that transports a medium, wherein the transport roller includes:

a shaft; and a wheel group in which a plurality of toothed wheels arrayed in a direction in which the shaft extends are held by holders, wherein the toothed wheel includes non-formation portions having no teeth, each of the non-formation portions protruding radially outwardly from a root of teeth of the toothed wheel, and wherein the non-formation portions of the plurality of toothed wheels of the wheel group are shifted in position from each other in a circumferential direction of the toothed wheels when the wheel group is viewed in the direction in which the shaft extends.

9. A transport roller for a transport apparatus that transports a medium, wherein the transport roller includes:

a shaft; and a wheel group in which a plurality of toothed wheels arrayed in a direction in which the shaft extends are held by holders, each of the plurality of toothed wheels being stacked alternately with each of the holders so that two adjacent toothed wheels are connected by one of the holders therebetween, wherein the toothed wheel includes non-formation portions having no teeth, and wherein the non-formation portions of the plurality of toothed wheels of the wheel group are shifted in position from each other in a circumferential direction of the toothed wheels when the wheel group is viewed in the direction in which the shaft extends.

10. A transport roller for a transport apparatus that transports a medium, wherein the transport roller includes:

a shaft; and a wheel group in which a plurality of toothed wheels arrayed in a direction in which the shaft extends are held by holders, wherein the toothed wheel includes non-formation portions having no teeth, and wherein the non-formation portions of the plurality of toothed wheels of the wheel group are shifted in position from each other in a circumferential direction of the toothed wheels when the wheel group is viewed in the direction in which the shaft extends.

* * * * *